US009709261B2

(12) United States Patent
Inoue et al.

(10) Patent No.: US 9,709,261 B2
(45) Date of Patent: Jul. 18, 2017

(54) CONDENSATE FLOW RATE CONTROL DEVICE AND CONDENSATE FLOW RATE CONTROL METHOD FOR POWER PLANT

(75) Inventors: Rikio Inoue, Tokyo (JP); Koichi Takei, Tokyo (JP); Yuichiro Deguchi, Tokyo (JP); Takanori Tsutsumi, Tokyo (JP); Yuji Ohta, Tokyo (JP); Kanta Inoue, Tokyo (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 898 days.

(21) Appl. No.: 13/882,685

(22) PCT Filed: Dec. 20, 2011

(86) PCT No.: PCT/JP2011/079454

§ 371 (c)(1),
(2), (4) Date: Jun. 5, 2013

(87) PCT Pub. No.: WO2012/090778

PCT Pub. Date: Jul. 5, 2012

(65) Prior Publication Data

US 2013/0263928 A1 Oct. 10, 2013

(30) Foreign Application Priority Data

Dec. 27, 2010 (JP) ..... 2010-291358
Dec. 27, 2010 (JP) ..... 2010-291361

(51) Int. Cl.
*F01K 13/02* (2006.01)
*F22D 5/26* (2006.01)
(Continued)

(52) U.S. Cl.
CPC ..... *F22D 5/26* (2013.01); *F01K 7/22* (2013.01); *F01K 7/44* (2013.01); *F01K 13/02* (2013.01); *Y10T 137/0374* (2015.04)

(58) Field of Classification Search
CPC . F01K 13/00; F01K 13/02; F01K 7/44; F22D 5/26; Y10T 137/0374
(Continued)

(56) References Cited

U.S. PATENT DOCUMENTS 3,953,966 A * 5/1976 Martz ..... F01K 13/02 60/39.182
4,345,438 A * 8/1982 Labbe ..... B01D 19/0063 60/657

FOREIGN PATENT DOCUMENTS

CN 1047363 A 11/1990
CN 101566079 A 10/2009
(Continued)

OTHER PUBLICATIONS

Notification of Transmittal of Translation of the International Preliminary Report on Patentability (Form PCT/IB/338) of International Application No. PCT/JP2011/079454 mailed Jul. 11, 2013 with Forms PCT/IB/373, PCT/ISA/237 and PCT/IB/326, w/English translation.
(Continued)

*Primary Examiner* — Laert Dounis
(74) *Attorney, Agent, or Firm* — Westerman, Hattori, Daniels & Adrian, LLP

(57) ABSTRACT

To provide a condensate flow rate control device and a control method for a power plant which improve responsiveness to frequency fluctuations or requested load changes and can suppress frequency fluctuations with precision or improve precision with which output power conforms to requested load instructions. A power plant to which a condensate flow rate control device is adapted includes a deaerator to which condensate generated by a condenser is supplied via a deaerator water level adjustment valve and into which bleed steam from a steam turbine is introduced. The condensate flow rate control device has a water level adjustment unit for executing condensate flow rate control, wherein the water level adjustment unit adjusts pressure in
(Continued)

a condensate flow path extending from the deaerator water level adjustment valve to the deaerator so that inputted frequency fluctuations are suppressed or an output value of a generator conforms to inputted requested load changes.

17 Claims, 22 Drawing Sheets

(51) Int. Cl.
*F01K 7/44* (2006.01)
*F01K 7/22* (2006.01)

(58) Field of Classification Search
USPC ..... 60/658, 660, 645, 646, 647, 652, 665, 60/667, 677
See application file for complete search history.

(56) References Cited

FOREIGN PATENT DOCUMENTS

| | | | | |
|---|---|---|---|---|
| DE | 3105355 A1 * | 2/1982 | ..... B01D 19/0063 | |
| JP | 57-010601 U | 1/1982 | | |
| JP | 4-252807 A | 9/1992 | | |
| JP | 273884 B2 * | 4/1998 | ..... F01D 15/10 | |
| JP | 2001-027104 A | 1/2001 | | |
| JP | 2007-93129 A | 4/2007 | | |
| JP | 2009-300038 A | 12/2009 | | |

OTHER PUBLICATIONS

Decision to Grant a Patent dated Apr. 16, 2014, issued in Japanese Application No. 2012-550858 with English Translation (6 pages).
Notice of Allowance dated Jun. 8, 2015, issued in counterpart Chinese Patent Application No. 201180050898.8, with English translation (4 pages).
International Search Report for PCT/JP2011/079454, mailing date of Apr. 3, 2012.
Chinese Office Action dated Jun. 19, 2014, issued in corresponding CN application No. 201180050898.8. with English translation (14 pages).

* cited by examiner

FIG.22A

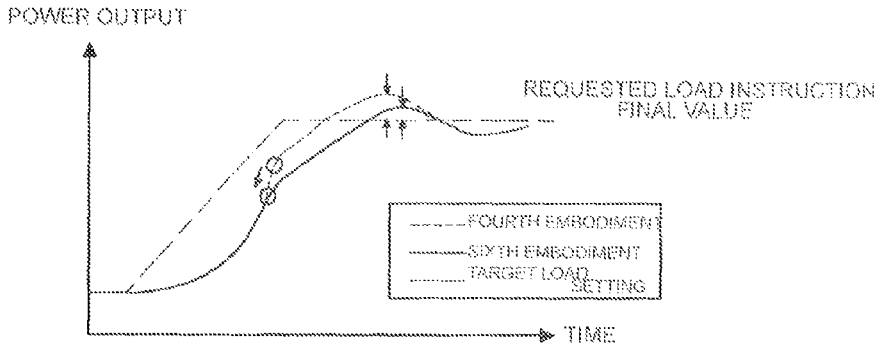

FIG.22B

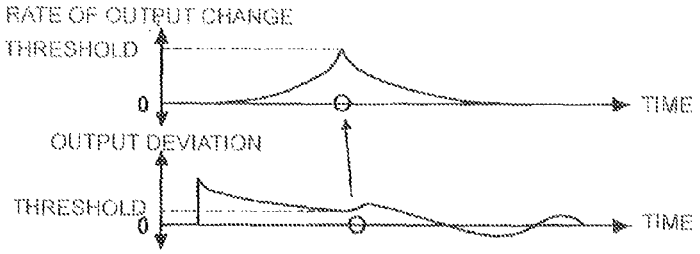

FIG.23

| FREQUENCY FLUCTUATION WIDTH | REMAINING NUMBER OF TIMES OF CONDENSATE FLOW RATE CONTROL | DEAERATOR WATER LEVEL SETTING VALUE |
|---|---|---|
| 0.1 Hz | 5 TIMES | (x−100)mm |
| 0.2 Hz | 4 TIMES | (x−200)mm |
| 0.3 Hz | 3 TIMES | (x−300)mm |
| 0.4 Hz | 2 TIMES | (x−400)mm |
| 0.5 Hz | 1 TIMES | (x−500)mm |
| REQUESTED LOAD CHANGE WIDTH | REMAINING NUMBER OF TIMES OF CONDENSATE FLOW RATE CONTROL | DEAERATOR WATER LEVEL SETTING VALUE |
| 0.1 MW | 5 TIMES | (x−100)mm |
| 0.2 MW | 4 TIMES | (x−200)mm |
| 0.3 MW | 3 TIMES | (x−300)mm |
| 0.4 MW | 2 TIMES | (x−400)mm |
| 0.5 MW | 1 TIMES | (x−500)mm |

NWL: NORMAL WATER LEVEL [mm]

x: PRESENT WATER LEVEL [mm]

y: WATER LEVEL FLUCTUATION AMOUNT [mm]

x − y: WATER LEVEL AFTER CONDENSATE FLOW RATE CONTROL [mm]

z: MAXIMUM VALUE OF WATER LEVEL FLUCTUATION AMOUNT [mm]

AL: WARNING WATER LEVEL [mm]

w: DIFFERENCE BETWEEN PRESENT WATER LEVEL AND WARNING WATER LEVEL [mm]

NWV: NORMAL HOLDING WATER AMOUNT [m3]
X: PRESENT HOLDING WATER AMOUNT [m3]
Y: HOLDING WATER AMOUNT FLUCTUATION AMOUNT [m3]
X - Y: HOLDING WATER AMOUNT AFTER CONDENSATE FLOW RATE CONTROL [m3]
Z: MAXIMUM VALUE OF HOLDING WATER AMOUNT FLUCTUATION AMOUNT [m3]
AV: WARNING WATER AMOUNT [m3]

PRIOR ART

CONDENSATE FLOW RATE CONTROL DEVICE AND CONDENSATE FLOW RATE CONTROL METHOD FOR POWER PLANT

TECHNICAL FIELD

The present invention relates to a condensate flow rate control device and a condensate flow rate control method for a power plant for controlling a condensate flow rate in accordance with a frequency fluctuation or a requested load change.

BACKGROUND ART

Conventionally, power plants are widely used in which a steam turbine generator is driven by steam and converts the steam into power. FIG. 29 is a diagram showing an ordinary thermal power plant. The thermal power plant comprises a boiler 10 which generates steam and a plurality of turbines 14, 16, and 18 which drives a generator 12 using steam from the boiler 10. Feed water is supplied to the boiler 10 from a feed pump 20 via a high-pressure feed water heater 22, and the boiler 10 generates main steam by heating the feed water.

The main steam is supplied to a high-pressure turbine 14 via a governor valve 24. Exhaust steam of the high-pressure turbine 14 is supplied to a reheater inside the boiler 10 as low-temperature reheat steam. High-temperature reheat steam that is reheated by the reheater is supplied to an intermediate-pressure turbine 16, and exhaust steam of the intermediate-pressure turbine 16 is supplied to a low-pressure turbine 18. Exhaust hot steam of the low-pressure turbine 18 is introduced into a condenser 26.

Condensate generated by cooling of exhaust hot steam in the condenser 26 is supplied from a condensate pump 28 to a deaerator 32 via a low-pressure feed water heater 30. Bleed steam of the intermediate-pressure turbine 16 is supplied to the deaerator 32, and oxygen contained in feed water is removed by heat of the bleed steam. Feed water discharged from the deaerator 32 is supplied to the boiler 10 via the feed pump 20 and the high-pressure feed water heater 22.

In this case, the deaerator 32 has a deaerator water storage tank which stores deaerated feed water, and a deaerator water level adjustment valve 34 is provided on a condensate supply line from the condenser 26 to the deaerator 32. An amount of the feed water stored in the deaerator water storage tank is kept constant by the deaerator water level adjustment valve 34. Therefore, during stable operation, an amount of the condensate supplied to the deaerator 32, an amount of the feed water supplied to the boiler 10, and an amount of the steam bled from the intermediate-pressure turbine 16 are maintained at a given balance in the deaerator 32.

In such a power plant, output control is performed in accordance with a requested load instruction from a power system. For example, Patent Document 1 (Japanese Patent Application Laid-open No. 2009-300038) discloses a configuration in which governor valve opening control, fuel flow rate control, or feed water flow rate control is performed based on a requested load signal to a boiler. In addition, when a frequency fluctuation in a power system or a power plant occurs, frequency control by a governor is performed. As described above, in a conventional power plant, output control in accordance with a requested load instruction or a frequency fluctuation is performed by means of steam flow rate control, steam pressure control, fuel flow rate control, air flow rate control, or governor valve opening control by a steam system of a boiler or the like.

Meanwhile, in recent years, in addition to large-scale power plants such as that described above, such output control is increasingly being introduced into power systems of dispersed power sources utilizing natural energy as exemplified by a wind farm or a large-scale photovoltaic power station. Since an amount of utilizable natural energy fluctuates due to reasons such as wind dying down in the case of wind power, output fluctuations occur with a dispersed power source. Since fine frequency fluctuations occur in the power system due to such output fluctuations, a power plant requires output control capable of stabilizing such frequency fluctuations. Conventionally, frequency control by means of opening control of a governor valve has been performed in a power plant in order to stabilize such frequency fluctuations.

Patent Document 1 Japanese Patent Application Laid-open No. 2009-300038

However, when frequency fluctuations of a power system are significant, conventional frequency control by means of opening control of a governor valve is, by itself, unable to sufficiently suppress the fluctuations and necessitates the fluctuations to be suppressed by control of a steam system of a boiler. However, with control by the steam system of a boiler such as that disclosed in Patent Document 1 or the like, for example, dead time or delay in response to a fuel flow rate instruction or combustion delay of coal as fuel in the boiler inhibits responsiveness of the control and prevents swift fluctuation suppression. In particular, since frequency fluctuations in a dispersed power source occur in relatively short time periods, it is extremely difficult to maintain a high precision in which the output control conforms to the frequency fluctuations.

DISCLOSURE OF THE INVENTION

Similarly, with control of the steam system of the boiler in response to an ordinary load change, delays to instructions become prominent when a rate of load change is high. As a result, in a similar manner to the case of frequency fluctuations, it is difficult to maintain a high precision in which the control conforms to load changes.

The present invention has been made in consideration of such problems in conventional art, and an object thereof is to provide a condensate flow rate control device and control method for a power plant which improve responsiveness to frequency fluctuations or requested load changes and can reliably suppress frequency fluctuations or improve precision with which power output conforms to requested load instructions.

In order to solve the problems described above, a condensate flow rate control device for a power plant according to the present invention is a condensate flow rate control device for a power plant which is adapted to a power plant including: a boiler; a steam turbine into which steam generated by the boiler is introduced; a generator driven by the steam turbine; a condenser to which exhaust hot steam from the steam turbine is supplied; a deaerator into which condensate generated by the condenser is supplied via a deaerator water level adjustment valve and into which bleed steam from the steam turbine is introduced; and a feed pump which supplies feed water deaerated by the deaerator to the boiler, wherein the condensate flow rate control device comprises a water level adjustment unit which conducts condensate flow rate control, into which a frequency fluctuation or a requested load change is inputted, and which adjusts pressure in a condensate flow path extending from the deaerator water level adjustment valve to the deaerator so that the inputted frequency fluctuation is suppressed or an output value of the generator conforms to the inputted requested load change, thereby adjusting an amount of bleed steam from the steam turbine.

With the condensate flow rate control device for a power plant according to the present invention, the amount of bleed steam from the steam turbine is controlled by adjusting the pressure in the condensate flow path from the deaerator water level adjustment valve to the deaerator in accordance with a frequency fluctuation or a requested load change. For example, output of the generator can be increased by reducing the amount of bleed steam, and the output of the generator can be reduced by increasing the amount of bleed steam. Output control by varying the amount of bleed steam as described above has a higher responsiveness than output control by a steam system of a boiler. Therefore, by adding the present configuration to the output control by the steam system of the boiler, responsiveness can be significantly improved in comparison to conventional configurations.

Consequently, according to the condensate flow rate control device for a power plant, suppression of frequency fluctuations or the precision with which power output conforms to requested load instructions can be improved. In addition, since the amount of bleed steam can be controlled without newly providing a bleed steam amount control valve, a power plant can be realized at a low cost. Moreover, output control by a steam system of a boiler refers to fuel flow rate control, feed water flow rate control, air flow rate control, steam flow rate control, steam pressure control, governor valve opening control, or the like.

In other words, the condensate flow rate control device for a power plant is designed so that energy of a steam turbine-side device is temporarily extracted and used to improve precision of conformance to a target frequency setting or a requested load setting. Therefore, suppression of frequency fluctuations and reduction of output deviation during high load changes can be realized. In particular, since a reduction in output deviation during high load changes reduces an increase in an opening of a governor valve which controls generator output, a main steam pressure deviation can be reduced.

Favorably, the power plant comprises a low-pressure heater which is arranged in the condensate flow path and to which bleed steam is supplied from the steam turbine, and moreover which heats the condensate.

According to this configuration, a temperature of feed water that is supplied to the boiler can be efficiently increased by the low-pressure heater. On the other hand, with this configuration, the amount of bleed steam supplied to the low-pressure heater is controlled by adjusting pressure of the condensate flow path. Therefore, even if a low-pressure heater is used, frequency fluctuations can be suppressed accurately or the precision in which power output conforms to requested load instructions can be increased.

Favorably, based on a relationship set in advance between a frequency fluctuation or a requested load change and a water level or a holding water amount of the deaerator, the water level adjustment unit calculates a setting value of the water level or a setting value of the holding water amount from the frequency fluctuation or the requested load change and outputs an opening instruction to the deaerator water level adjustment valve so that the water level or the holding water amount of the deaerator assumes the setting value of the water level or the setting value of the holding water amount.

With this configuration, the amount of bleed steam from the steam turbine is controlled by changing the setting value of a water level or the setting value of the holding water amount. According to this configuration, pressure of the condensate flow path can be adjusted to control the amount of bleed steam from the steam turbine with a simple configuration and in a reliable manner.

Moreover, in this configuration, both a frequency fluctuation and a requested load change may be used to calculate the setting value of the water level or the setting value of the holding water amount. Furthermore, an opening instruction of the deaerator water level adjustment valve may be an opening instruction value or a pair consisting of an opening upper limit and an opening lower limit.

Favorably, the condensate flow rate control device for a power plant further comprises a returning unit which conducts return control for returning a setting value of the water level, a setting value of the holding water amount, or an opening of the deaerator water level adjustment valve to a setting value prior to the condensate flow rate control by the water level adjustment unit when a predetermined return condition is satisfied.

According to this configuration, the setting value of the water level, the setting value of the holding water amount, or the opening of the deaerator water level adjustment valve can be restored with a simple configuration and in a reliable manner. Therefore, the water level of the deaerator can be prevented from falling below a lower limit when the condensate flow rate control is executed by the water level adjustment unit. In addition, as a result of the water level of the deaerator being restored, the water level adjustment unit can repetitively execute the condensate flow rate control.

Favorably, the return unit returns the setting value of the water level, the setting value of the holding water amount, or the opening of the deaerator water level adjustment valve to a setting value prior to the condensate flow rate control by the water level adjustment unit either at a constant rate of change or in stages.

According to this configuration, since an abrupt output change due to execution of the return control can be prevented, destabilization of an operation of the power plant can be prevented and the power plant can be operated in a stable manner.

Favorably, the return unit calculates a deviation between an instruction final value of a requested load in the requested load change and an output value of the generator, and conducts the return control when the deviation equals or falls below a preset threshold as the return condition.

According to this configuration, a deviation between the instruction final value of a requested load and the power output value is monitored, and the return control is conducted when the deviation equals or falls below a preset threshold. Therefore, since the return control is executed before the power output value reaches the instruction final value of a requested load, excessive power output can be prevented.

Favorably, the return unit calculates a rate of change of the output value of the generator, and conducts the return control when the rate of change equals or exceeds a preset threshold as the return condition.

According to this configuration, the rate of change of the power output value is monitored, and the return control is conducted when the rate of change equals or exceeds a preset threshold. Therefore, since the return control is executed before the power output value reaches the instruction final value of a requested load, excessive power output can be prevented.

Favorably, a detected value of a water level or a holding water amount of the deaerator is inputted to the return unit, and the return unit conducts the return control when the detected value of the water level or the holding water amount reaches a setting value of the water level or the holding water amount as the return condition.

According to this configuration, the setting value prior to the condensate flow rate control can be restored with a simple configuration and in a reliable manner.

Favorably, the return unit conducts the return control upon lapse of a set period that is set in advance from a moment of occurrence of the frequency fluctuation or the requested load change as the return condition.

According to this configuration, a setting value prior to the condensate flow rate control can be restored with simple control and in a stable manner.

Favorably, the return unit conducts the return control upon lapse of a set period that is set in advance from a moment when frequency or the output value of the generator reaches a target frequency setting or a requested load setting as the return condition.

With this configuration, the water level of the deaerator can be returned to the setting value prior to the condensate flow rate control upon lapse of a set period that enables sufficient stabilization of the deaerator water level and the output which had changed due to the condensate flow rate control with respect to the frequency fluctuation or the requested load change. According to this configuration, disturbance due to output fluctuations when restoring the deaerator water level can be suppressed, and the water level of the deaerator can be returned to the setting value prior to the condensate flow rate control with simple control and in a stable manner so as to suppress output fluctuations.

Favorably, the water level adjustment unit calculates a setting value of the water level or a setting value of the holding water amount based on a differential value of a width of the frequency fluctuation or a differential value of the requested load change.

According to this configuration, excessive power output can be reliably prevented when the frequency fluctuation or the requested load change changes abruptly.

Favorably, a detected value of a water level or a holding water amount of the deaerator at a moment of occurrence of the frequency fluctuation or the requested load change is inputted to the water level adjustment unit, and when the detected value of the water level or the detected value of the holding water amount is lower than a threshold set in advance, the water level adjustment unit disables the condensate flow rate control or conducts the condensate flow rate control while adjusting the setting value of the water level or the setting value of the holding water amount.

According to this configuration, the water level of the deaerator is prevented from falling below a lower limit and the power plant can be operated in a stable manner.

Favorably, the condensate flow rate control device for a power plant further comprises: an allowable control count calculating unit which displays at least one estimated value of a frequency fluctuation or a requested load change which is estimated to be inputted and which computes a remaining number of times the water level adjustment unit can conduct the condensate flow rate control based on the estimated value, a detected value of a water level or a holding water amount of the deaerator, and a lower limit of the water level or the holding water amount of the deaerator; and a display unit which displays the remaining number of times computed by the allowable control count calculating unit in association with the estimated value.

According to this configuration, a manager of a power plant can instantaneously make a decision on whether or not a frequency fluctuation or a requested load change can be accommodated by the condensate flow rate control executed by the water level adjustment unit.

Favorably, the condensate flow rate control device for a power plant further comprises a switch which can be operated by a manager and which is used to switch between enabling and disabling the condensate flow rate control by the water level adjustment unit.

According to this configuration, the execution of the condensate flow rate control by the water level adjustment unit can be permitted or prohibited based on the manager's decision. Therefore, the manager can accommodate a frequency fluctuation or a requested load change in a flexible manner.

Favorably, when the frequency fluctuation or the requested load change that is consistent with the estimated value is inputted and the number of times computed based on the estimated value is zero, the condensate flow rate control by the water level adjustment unit is disabled regardless of operations of the switch by the manager.

According to this configuration, the execution of the condensate flow rate control by the water level adjustment unit can be prohibited when the number of times is zero regardless of the decision made by the manager. Therefore, the condensate flow rate control can be prevented from being erroneously executed and the power plant can be operated in a stable manner.

Favorably, the power plant comprises a makeup water supplying unit which supplies makeup water to the deaerator in accordance with a water level or a holding water amount of the deaerator, and the makeup water supplying unit includes a makeup water tank which stores the makeup water, a makeup water supply amount adjusting unit which adjusts a makeup water supply amount that is supplied from the makeup water tank to the deaerator, and a heating unit which heats the makeup water.

According to this configuration, since the power plant comprises the makeup water supplying unit, even when the water level in the deaerator drops due to the condensate flow rate control with respect to a frequency fluctuation or a requested load change, the water level can be restored by supplying makeup water to the deaerator by the makeup water supplying unit. Therefore, according to this configuration, the boiler can be operated in a stable manner.

Favorably, the heating unit heats the makeup water by using waste heat from the boiler or waste heat from another heating source.

According to this configuration, waste heat is used efficiently and heat efficiency in the entire power plant is improved.

In addition, a condensate flow rate control method for a power plant according to the present invention is a condensate flow rate control method for a power plant, which is applicable to a power plant having: a boiler; a steam turbine into which steam generated by the boiler is introduced; a generator driven by the steam turbine; a condenser to which exhaust hot steam from the steam turbine is supplied; a deaerator into which condensate generated by the condenser is supplied via a deaerator water level adjustment valve and into which bleed steam from the steam turbine is introduced; and a feed pump which supplies feed water deaerated by the deaerator to the boiler, the method implementing condensate flow rate control such that a frequency fluctuation or a requested load change is inputted, and pressure in a condensate flow path from the deaerator water level adjustment valve to the deaerator is adjusted so that the inputted frequency fluctuation is suppressed or an output value of the generator conforms to the inputted requested load change, thereby adjusting the amount of bleed steam from the steam turbine.

With the condensate flow rate control method for a power plant according to the present invention, the amount of bleed steam from the steam turbine is controlled by adjusting the pressure in the condensate flow path from the deaerator water level adjustment valve to the deaerator in accordance with a frequency fluctuation or a requested load change. Output control by varying the amount of bleed steam has a higher responsiveness than output control by a steam system of a boiler. Therefore, by adding the present configuration to the output control by the steam system of the boiler, responsiveness can be significantly improved in comparison to conventional configurations.

Consequently, according to the condensate flow rate control method for a power plant, suppression of frequency fluctuations or the precision with which power output conforms to requested load instructions can be improved. In addition, since the amount of bleed steam can be controlled without newly providing a bleed steam amount control valve, the condensate flow rate control device for a power plant can be realized at a low cost.

As described above, according to the present invention, a condensate flow rate control device and control method for a power plant are provided which improve responsiveness to frequency fluctuations or requested load changes and which are capable of reducing frequency fluctuations with precision or improving precision with which power output conforms to requested load instructions.

BRIEF DESCRIPTION OF THE DRAWINGS

FIG. 22A is a graph describing how power output conforms to a target load setting according to the sixth embodiment, and FIG. 22B is a graph describing a change over time in a rate of output change according to the sixth embodiment and in the output deviation according to the fourth embodiment;

FIG. 23 is a diagram showing display contents of a display unit in a control device according to a seventh embodiment of the present invention;

BEST MODE FOR CARRYING OUT THE INVENTION

Hereinafter, preferred embodiments of the present invention will be described in detail in an exemplary manner with reference to the drawings. However, it should be noted that unless specifically noted otherwise, dimensions, materials, shapes, relative arrangements, and the like of components described in the embodiments below are not intended to limit the spirit and scope of the invention to such dimensions, materials, shapes, relative arrangements, and the like, and are simply examples.

First Embodiment

Figure 1:
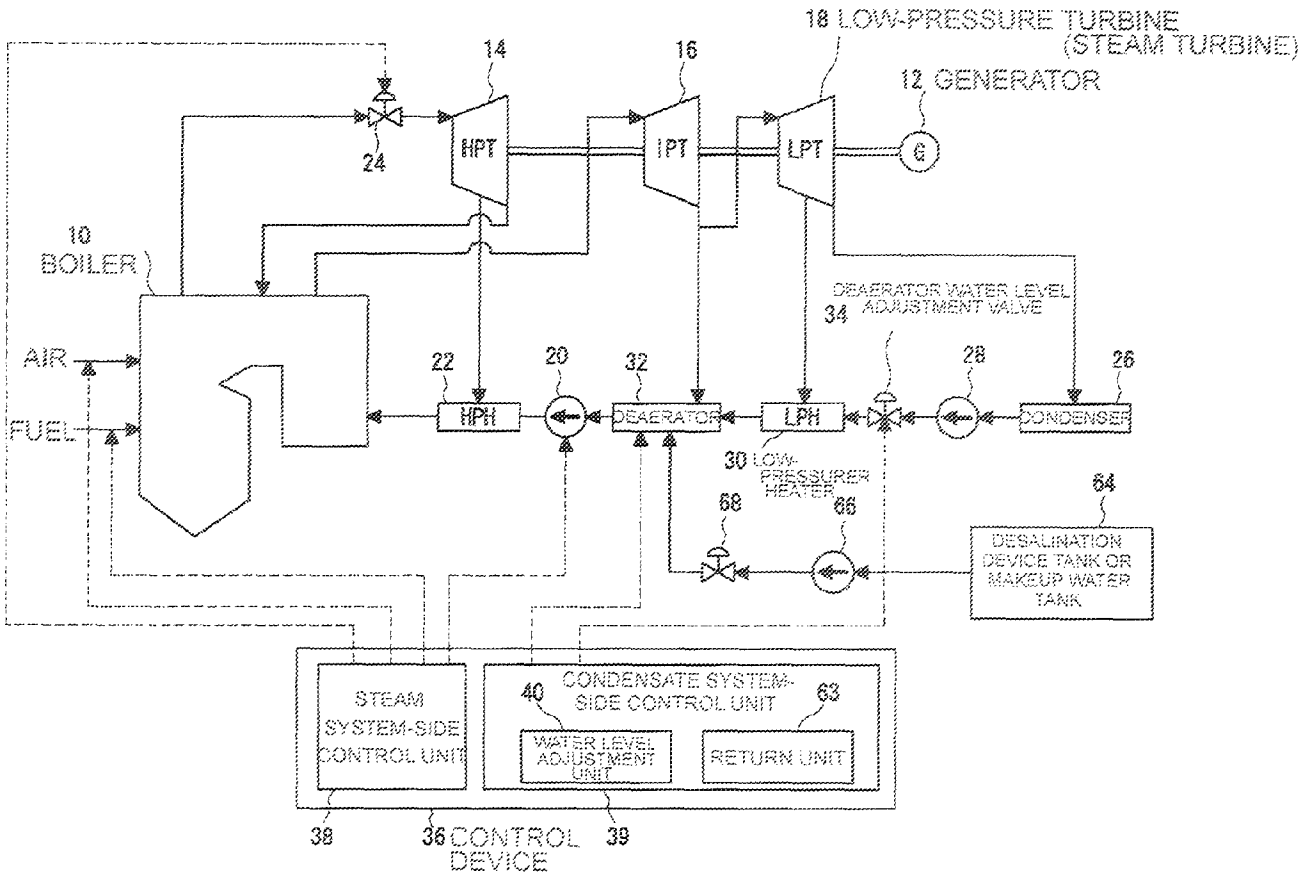
FIG. 1 is an overall configuration diagram of a power plant comprising a power plant control device according to a first embodiment of the present invention.

First, a configuration of a power plant to which an embodiment of the present invention is adapted will be described. FIG. 1 is an overall configuration diagram of a power plant comprising a control device 36 according to a first embodiment of the present invention. A steam system side of the power plant comprises a boiler 10, a high-pressure turbine 14, an intermediate-pressure turbine 16, and a low-pressure turbine 18. In addition, a condensate system side comprises a condenser 26, a low-pressure feed water heater (low-pressure heater) 30, a deaerator 32, and a high-pressure feed water heater 22.

The boiler 10 heats feed water supplied from the high-pressure feed water heater 22 to generate main steam. The main steam is introduced to the high-pressure turbine 14 via a governor valve 24. The governor valve 24 mainly controls output (power output) of the generator 12.

Exhaust steam that is discharged by driving the high-pressure turbine 14 is supplied to a reheater inside the boiler 10 as low-temperature reheat steam. High-temperature reheat steam that is reheated by the reheater is supplied to the intermediate-pressure turbine 16 and exhaust steam of the intermediate-pressure turbine 16 is supplied to the low-pressure turbine 18. Exhaust hot steam of the low-pressure turbine 18 is introduced into the condenser 26.

Condensate generated by cooling of exhaust hot steam in the condenser 26 is supplied from a condensate pump 28 to the deaerator 32 via the low-pressure feed water heater 30. A flow rate of the condensate supplied to the deaerator 32 is adjusted by a deaerator water level adjustment valve 34 that is installed on a feed water line (condensate flow path) on an upstream side of the deaerator 32.

As an example, the deaerator water level adjustment valve 34 is installed between the condensate pump 28 and the low-pressure feed water heater 30. Bleed steam of the intermediate-pressure turbine 16 is supplied to the deaerator 32, and oxygen contained in the feed water is removed by heat of the bleed steam. The feed water from which oxygen has been removed is stored in a deaerator water storage tank of the deaerator 32. The feed pump 20 supplies the feed water stored in the deaerator water storage tank to the boiler 10 via the high-pressure feed water heater 22.

Moreover, although not shown, the deaerator 32 is provided with a water level detector as a water level detecting unit for detecting a water level of the feed water stored in the deaerator water storage tank (a water level of the deaerator 32). A detected value of the water level detected by the water level detector is inputted to the control device 36.

The high-pressure feed water heater 22 and the low-pressure feed water heater 30 heat condensate or feed water which flows inside thereof using steam. Steam supplied to the high-pressure feed water heater 22 is bleed steam extracted from center of the high-pressure turbine 14. Steam supplied to the low-pressure feed water heater 30 is bleed steam extracted from center of the low-pressure turbine 18.

The power plant configured as described above comprises the control device 36. The control device 36 is comprised of a computer that is constituted by, for example, a processing unit, a storage device, an input/output device, and the like. The control device 36 includes a steam system-side control unit 38 and a condensate system-side control unit 39. Moreover, the control device 36 according to the present embodiment need only include at least the condensate system-side control unit 39 and may be configured such that the condensate system-side control unit 39 is added to an existing steam system-side control unit 38. The control device 36 comprising at least the condensate system-side control unit 39 is also referred to as a condensate flow rate control device.

Figure 2:
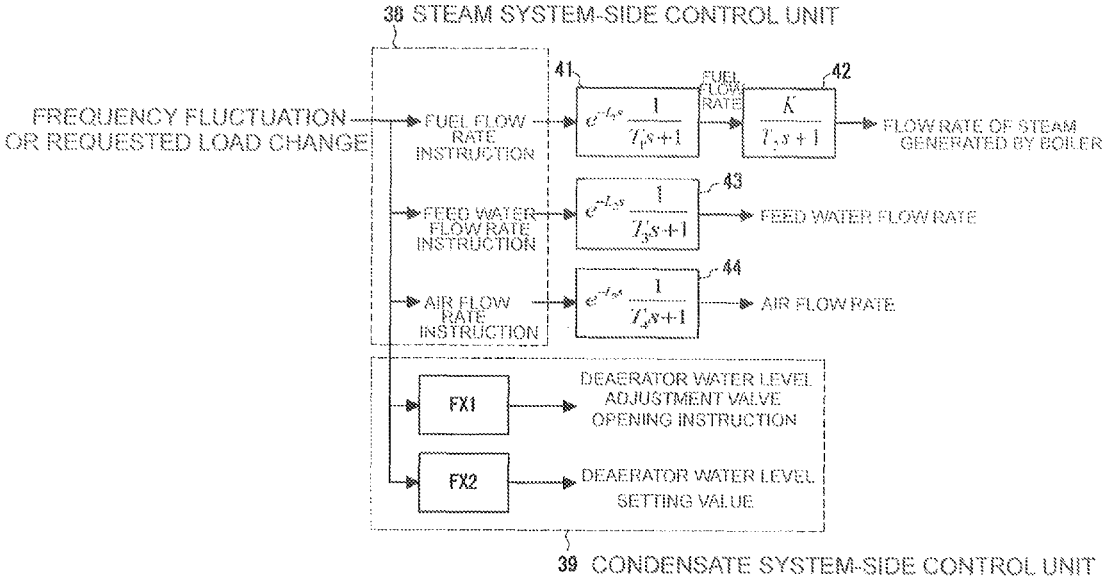
FIG. 2 is a specific configuration diagram of the control device according to the first embodiment of the present invention.
Figure 3:
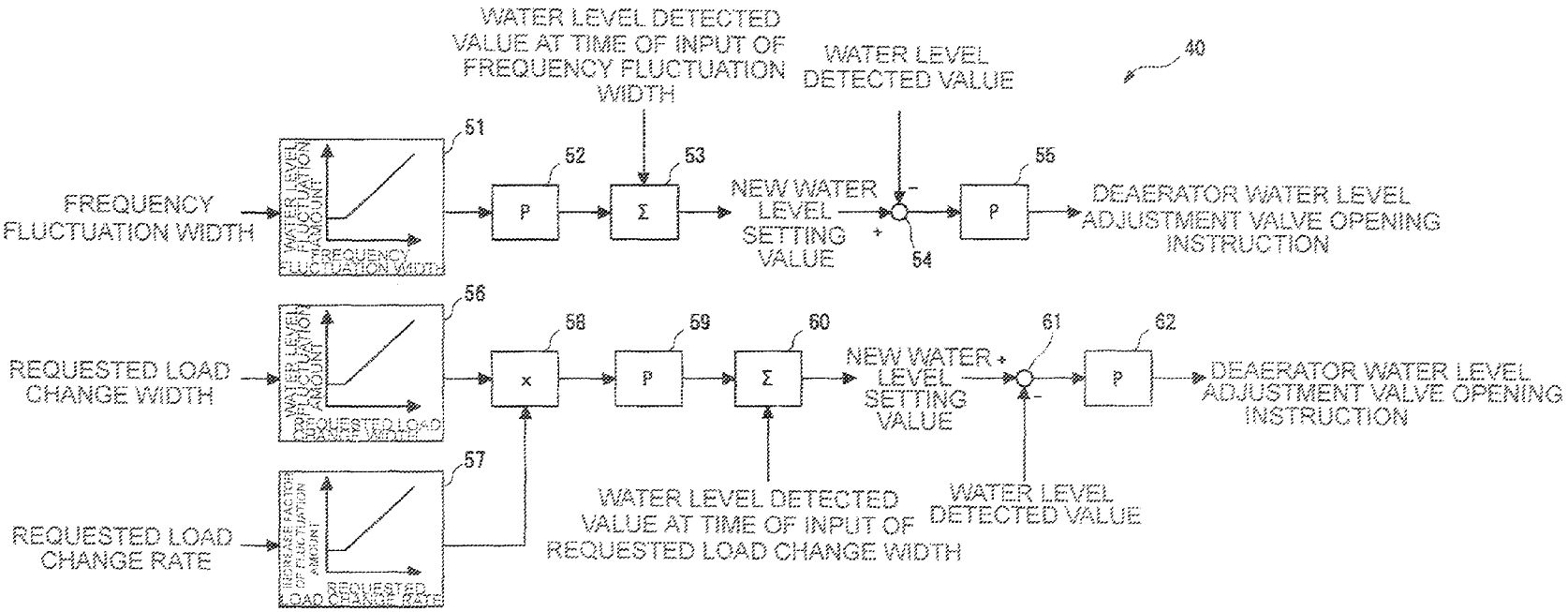
FIG. 3 is a diagram showing a configuration example of a water level adjustment unit in the control device according to the first embodiment of the present invention.

Specific configurations of the steam system-side control unit 38 and the condensate system-side control unit 39 will be described with reference to FIGS. 2 and 3. FIG. 2 is a specific configuration diagram of the control device 36, and FIG. 3 is a diagram showing a configuration example of the condensate system-side control unit 39 of the control device 36.

In FIG. 2, a frequency fluctuation or a requested load change is respectively inputted to the steam system-side control unit 38 and the condensate system-side control unit 39. Moreover, the frequency fluctuation or the requested load change is calculated based on a system frequency or a requested load by an amount of change calculating unit (not shown).

The steam system-side control unit 38 performs output control of the generator 12 by controlling steam system-side parameters as in the case of fuel flow rate control, feed water flow rate control, air flow rate control, steam flow rate control, steam pressure control, governor valve opening control, or the like.

In the example shown in FIG. 2, the steam system-side control unit 38 performs fuel flow rate control, feed water flow rate control, and air flow rate control. In FIG. 2, L1 denotes a dead time with respect to a fuel flow rate instruction, L2 denotes a dead time with respect to a feed water flow rate instruction, L3 denotes a dead time with respect to an air flow rate control instruction, T1 denotes a delay to a fuel flow rate instruction, T2 denotes a combustion delay in the boiler, T3 denotes a delay to a feed water flow rate instruction, and T4 denotes a delay to an air flow rate control instruction.

First, the steam system-side control unit 38 calculates a fuel flow rate instruction for suppressing a frequency fluctuation or a fuel flow rate instruction in accordance with a requested load change and outputs the fuel flow rate instruction to a fuel flow rate adjusting unit (not shown) of the boiler 10. Based on the fuel flow rate instruction, for example, the fuel flow rate adjusting unit of the boiler 10 supplies coal as fuel.

Moreover, in reality, a fuel flow rate that is adjusted by the fuel flow rate adjusting unit of the boiler 10 contains a dead time L1 and a time constant T1 with respect to the fuel flow rate instruction as indicated by reference numeral 41. In addition, a steam flow rate generated by the boiler 10 further contains a time constant T2 with respect to the fuel flow rate as indicated by reference numeral 42.

In a similar manner, with a feed water flow rate, the steam system-side control unit 38 calculates a feed water flow rate instruction for suppressing a frequency fluctuation or a feed water flow rate instruction in accordance with a requested load change and outputs the feed water flow rate instruction to a feed water flow rate adjusting unit (not shown) of the boiler 10. Moreover, in reality, a feed water flow rate that is adjusted by the feed water flow rate adjusting unit of the boiler 10 contains a dead time L2 and a time constant T3 with respect to the feed water flow rate instruction as indicated by reference numeral 43.

Furthermore, in a similar manner, with an air flow rate, the steam system-side control unit 38 calculates an air flow rate instruction for suppressing a frequency fluctuation or an air flow rate instruction in accordance with a requested load change and outputs the air flow rate instruction to an air flow rate adjusting unit (not shown) of the boiler 10. Moreover, in reality, an air flow rate that is adjusted by the air flow rate adjusting unit of the boiler 10 contains a dead time L3 and a time constant T4 with respect to the air flow rate instruction as indicated by reference numeral 44.

As described above, with control by the steam system-side control unit 38, it is difficult to adjust a steam flow rate, a feed water flow rate, or an air flow rate with precision due to response delays to control signals.

Conversely, in the present embodiment, the control device 36 comprises the condensate system-side control unit 39 described in detail below and is capable of significantly improving responsiveness of the control due to the condensate system-side control unit 39.

The condensate system-side control unit 39 performs output control of the generator 12 by controlling pressure of a condensate flow path that extends from the deaerator water level adjustment valve 34 to the deaerator 32. Specifically, the output control is performed by means of condensate flow rate control (deaerator water level control) in which a flow rate of condensate flowing through the condensate flow path is controlled.

The condensate system-side control unit 39 comprises a water level adjustment unit 40 which executes condensate flow rate control. Based on a relationship between a frequency fluctuation or a requested load change set in advance and a water level of the deaerator water storage tank of the deaerator 32, the water level adjustment unit 40 calculates a setting value of the water level from the frequency fluctuation or the requested load change. In addition, the water level adjustment unit 40 outputs an opening instruction to the deaerator water level adjustment valve 34 so that the water level of the deaerator water storage tank equals the setting value of the water level.

According to the relationship between the frequency fluctuation or the requested load change set in advance and the water level of the deaerator 32, a setting value of the water level which causes the amount of bleed steam of the low-pressure turbine 18 to vary in a direction that suppresses the frequency fluctuation is associated with the frequency fluctuation, and a setting value of the water level which causes the amount of bleed steam of the low-pressure turbine 18 to vary in a direction in which the output value of the generator 12 conforms to the requested load change is associated with the requested load change.

Moreover, the opening instruction of the deaerator water level adjustment valve 34 may be an opening instruction value or a pair consisting of an opening upper limit and an opening lower limit which limits the opening of the deaerator water level adjustment valve 34 to within a predetermined range.

For example, as shown in FIG. 3, the condensate system-side control unit 39 comprises a table function unit 51, a correction function unit 52, an adder 53, a deviation computing unit 54, and a controller 55 as the water level adjustment unit 40.

A function of a fluctuation width of the water level with respect to a frequency fluctuation width is set in advance to the table function unit 51. In other words, the fluctuation amount of the water level of the deaerator 32 corresponding to the frequency fluctuation width is set to the table function unit 51, and the table function unit 51 outputs a fluctuation amount of the water level which corresponds to an inputted frequency fluctuation width. Moreover, in the table function unit 51, the fluctuation amount of the water level is set so as to cause the amount of bleed steam of the steam turbine to vary in a direction that suppresses corresponding frequency fluctuation.

The correction function unit 52 corrects an inputted fluctuation width of the water level in accordance with the deaerator 32. The correction function unit 52 multiples the fluctuation amount of the water level outputted from the table function unit 51 by an appropriate factor such as −1, and outputs an obtained product as a correction amount of the water level.

A detected value of the water level at the time of input of the frequency fluctuation width is inputted to the adder 53 together with the correction amount of the water level outputted by the correction function unit 52. The adder 53 computes a sum of the correction amount of the water level and the detected value of the water level, and outputs the obtained sum as a new setting value of the water level.

Moreover, a setting value of the water level upon occurrence of a frequency fluctuation may be inputted to the adder 53 instead of the detected value of the water level.

A current detected value (process value) of the water level is inputted to the deviation computing unit 54 together with the new setting value of the water level outputted by the adder 53. The deviation computing unit 54 computes a deviation between the new setting value of the water level and the process value, and outputs the obtained deviation.

The controller 55 executes, for example, proportional control based on the inputted deviation. In other words, the controller 55 generates an opening instruction which reduces the deviation and outputs the opening instruction to the deaerator water level adjustment valve 34.

Moreover, a setting value (initial value) of the water level until just before the frequency fluctuation width is inputted is, for example, set based on a predetermined function in accordance with a statically setting value of the requested load until just before the frequency fluctuation width is inputted. Therefore, until just before the frequency fluctuation width is inputted, an opening instruction is generated so that the process value of the water level approaches the initial value of the water level and the opening instruction is outputted to the deaerator water level adjustment valve 34.

In addition, the condensate system-side control unit 39 comprises a table function unit 56, a table function unit 57, a multiplier (integrator) 58, a correction function unit 59, an adder 60, a deviation computing unit 61, and a controller 62 as the water level adjustment unit 40.

A function of a fluctuation width of the water level with respect to a requested load change width is set in advance to the table function unit 56. In other words, the fluctuation amount of the water level of the deaerator 32 corresponding to the requested load change width is set to the table function unit 56, and the table function unit 56 outputs a fluctuation amount of the water level which corresponds to an inputted requested load change width. Moreover, in the table function unit 56, the fluctuation amount of the water level is set so as to cause the amount of bleed steam of the steam turbine to vary in a direction in which output of the generator 12 conforms to a corresponding load change.

A function of an increase factor of a fluctuation width of the water level corresponding to a requested load change rate is set in advance to the table function unit 57. In other words, an increase factor of the fluctuation amount of the water level corresponding to the requested load change rate is set to the table function unit 57, and the table function unit 57 outputs an increase factor of a fluctuation amount of the water level which corresponds to an inputted requested load change width. Moreover, in the table function unit 57, the increase factor of the fluctuation amount of the water level is set such that the greater the requested load change rate in excess of a predetermined value, the greater the increase factor. For example, the increase factor is within a range of 1 or more and 2 or less.

The multiplier 58 multiplies an inputted fluctuation amount of the water level by the increase factor of the fluctuation amount, and outputs an obtained product as a fluctuation amount of the water level.

The correction function unit 59 corrects the fluctuation width of the water level in accordance with the deaerator 32. The correction function unit 59 multiples the fluctuation amount of the water level outputted from the multiplier 58 by an appropriate factor such as −1, and outputs the obtained product as a correction amount of the water level.

A detected value of the water level at the time of input of the requested load change width is inputted to the adder 60 together with the correction amount of the water level outputted by the correction function unit 59. The adder 60 computes a sum of the correction amount of the water level and the detected value of the water level, and outputs the obtained sum as a new setting value of the water level.

Moreover, a setting value of the water level upon occurrence of a requested load change may be inputted to the adder 60 instead of the detected value of the water level.

A current detected value (process value) of the water level is inputted to the deviation computing unit 61 together with the new setting value of the water level outputted by the adder 60. The deviation computing unit 54 computes a deviation between the new setting value of the water level and the process value, and outputs the obtained deviation.

The controller 62 executes, for example, proportional control based on the inputted deviation. In other words, the controller 62 generates an opening instruction which reduces the deviation and outputs the opening instruction to the deaerator water level adjustment valve 34.

Moreover, in the present embodiment, while an opening instruction is outputted based on a new setting value of the water level both in a case where a frequency fluctuation is inputted and a case where a requested load change is inputted, an opening instruction may be arranged so as to be outputted based on a new setting value of the water level only in any one of the cases.

In addition, when a requested load change is inputted, only one of a requested load change width and a requested load change rate may be arranged so as to be inputted. In this case, for example, the table function unit 57 may be omitted and the fluctuation amount of the water level outputted by the table function unit 56 may be directly inputted to the correction function unit 59. Alternatively, the table function unit 56 may be omitted and, at the same time, another table function unit which outputs a fluctuation amount of the water level based on an inputted requested load change rate may be used instead of the table function unit 57. In addition, the fluctuation amount of the water level outputted by the other table function unit may be directly to the correction function unit 59.

As shown, with the control device 36 of the power plant described above, by varying pressure in the condensate flow path extending from the deaerator water level adjustment valve 34 to the deaerator 32 in accordance with a frequency fluctuation or a requested load change, the amount of bleed steam supplied to the low-pressure feed water heater 30 from the low-pressure turbine 18 is varied to control the output of the generator 12. In other words, by varying the water level of the deaerator 32, the amount of bleed steam supplied to the low-pressure feed water heater 30 from the low-pressure turbine 18 is varied to control power output.

Output control by varying the amount of bleed steam has a higher responsiveness than that of output control according to the steam system of the boiler 10, and by adding the present configuration to the output control according to the steam system of the boiler 10, responsiveness can be significantly improved as compared to conventional configurations. Therefore, the precision in which power output conforms to requested load instructions can be improved.

In addition, in the present configuration, since energy of a steam turbine-side device is temporarily extracted and used to improve the precision of conformance to a target frequency setting or a requested load setting, suppression of frequency fluctuations or reduction of output deviation during a high load change can be realized. In particular, since a reduction in the output deviation during a load increase at a high rate of load change reduces an increase in the opening of the governor valve 24 which controls the power output, a main steam pressure deviation can be reduced. Furthermore, since the amount of bleed steam can be controlled without newly providing a bleed steam amount control valve between the low-pressure turbine 18 and the low-pressure feed water heater 30, a power plant can be realized at a low cost.

Figure 4:
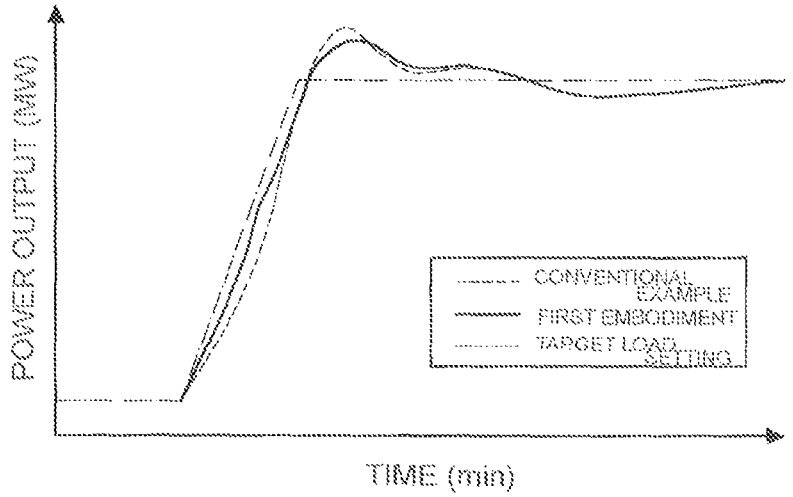
FIG. 4 is graph describing how power output conforms to a target load setting according to the first embodiment.

FIG. 4 is a graph describing how output conforms to a target load setting.

In FIG. 4, a line of a conventional example represents a change over time of power output when only the output control by the steam system-side control unit 38 is used, and a line of the first embodiment represents a change over time of power output when both the output control by the steam system-side control unit 38 and the output control by the condensate system-side control unit 39 are used. As shown by the graph of FIG. 4, according to the present embodiment, conformance to a target load setting (target output) can be increased.

The configuration of the first embodiment described above may include the following configurations.

The condensate system-side control unit 39 may further comprise a return unit 63 (refer to FIG. 1). When a predetermined return condition is satisfied, the return unit 63 executes return control in which the setting value of the water level or the opening of the deaerator water level adjustment valve 34 is returned to a setting value (initial value) prior to adjustment by the water level adjustment unit 40. Favorably, the return condition is that the detected value of the water level of the deaerator 32 reaches the setting value of the water level.

Figure 5A:
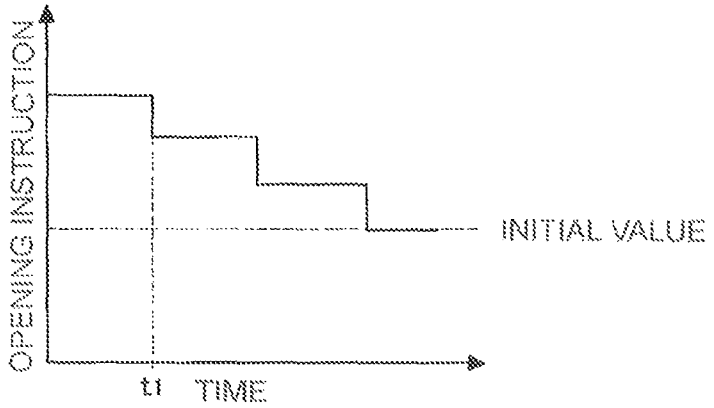
FIG. 5A is a diagram for describing a method of restoring an opening of a deaerator water level adjustment valve in stages.
Figure 5B:
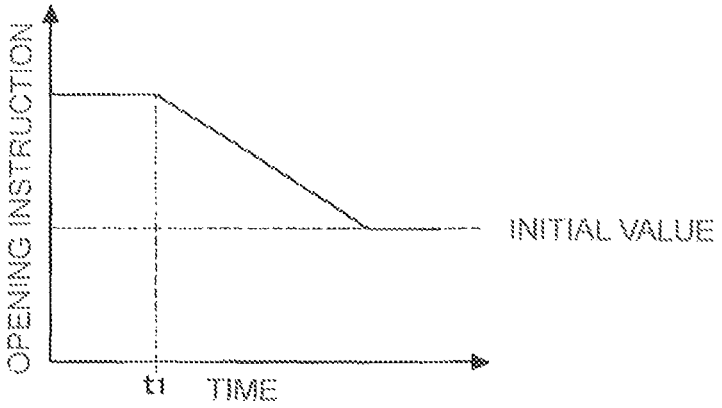
FIG. 5B is a diagram for describing a method of restoring the opening of the deaerator water level adjustment valve at a constant rate of change.

In addition, favorably, at a moment (t1) where the return condition is satisfied, the return unit 63 returns the opening of the deaerator water level adjustment valve 34 to the initial value either in stages as shown in FIG. 5A or at a constant rate of change as shown in FIG. 5B. In this case, the return unit 63 is a valve opening return unit.

Figure 6:
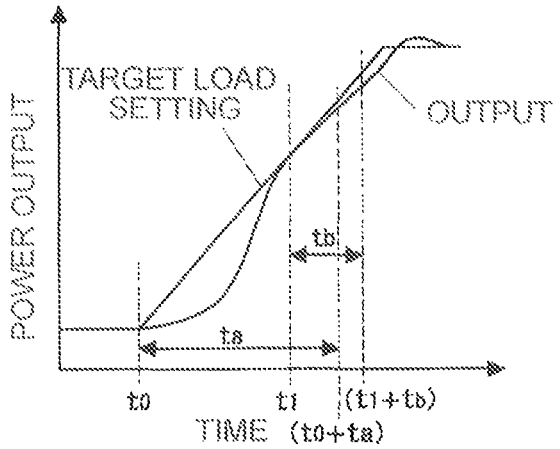
FIG. 6 is a diagram for describing setting a period of a return unit.
Figure 7A:
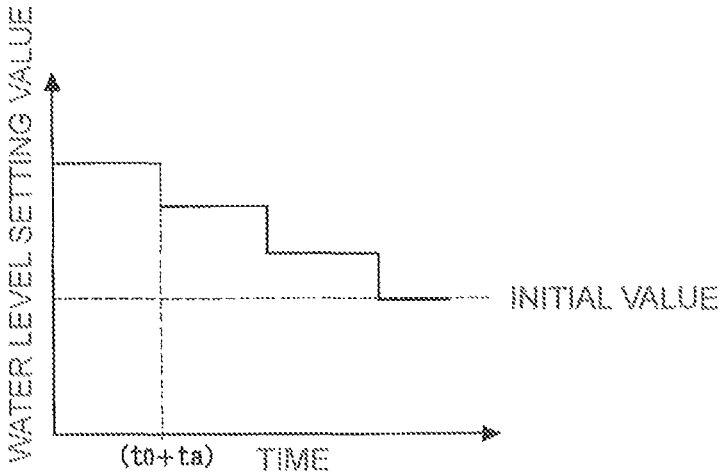
FIG. 7A is a diagram for describing a method of restoring a setting value of a water level of a deaerator in stages.
Figure 7B:
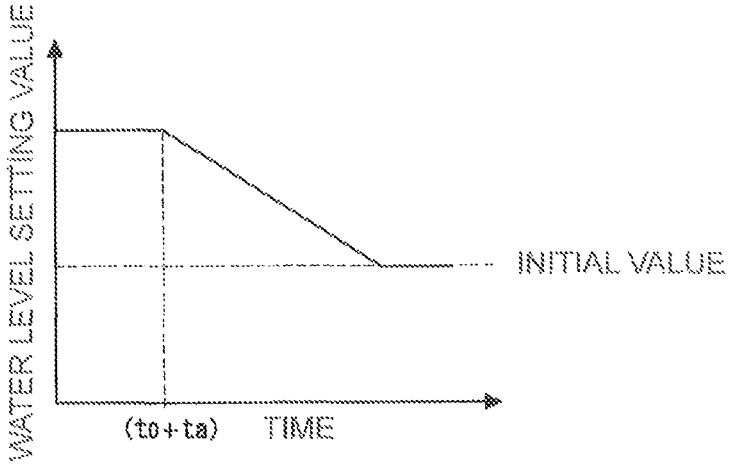
FIG. 7B is a diagram for describing a method of restoring the setting value of the water level of the deaerator at a constant rate of change.

Furthermore, upon lapse of a set period to that is set in advance from a moment of occurrence t0 of a frequency fluctuation or a requested load change as shown in FIG. 6, the return unit 63 may return the water level of the deaerator 32 to the initial value either in stages as shown in FIG. 7A or at a constant rate of change as shown in FIG. 7B. In this case, the return unit 63 is a water level setting return unit.

Moreover, upon lapse of a set period tb that is set in advance from a moment t1 where a system frequency or a request load had reached a target frequency setting or a requested load setting as shown in FIG. 6, the return unit 63 may return the setting value of the water level of the deaerator 32 to the initial value either in stages as shown in FIG. 7A or at a constant rate of change as shown in FIG. 7B. In this case, the return unit 63 is a water level setting return unit.

Furthermore, the power plant may comprise a makeup water supplying unit. The makeup water supplying unit replenishes feed water to the deaerator 32 when the water level of the deaerator 32 drops in the condensate system-side control unit 39. In this case, the makeup water supplying unit favorably replenishes heated feed water.

Modifications of a power plant to which the control device 36 according to the present embodiment can be adapted will be described with reference to FIGS. 8 to 11. The power plants according to these modifications comprise a makeup water supplying unit.

Figure 8:
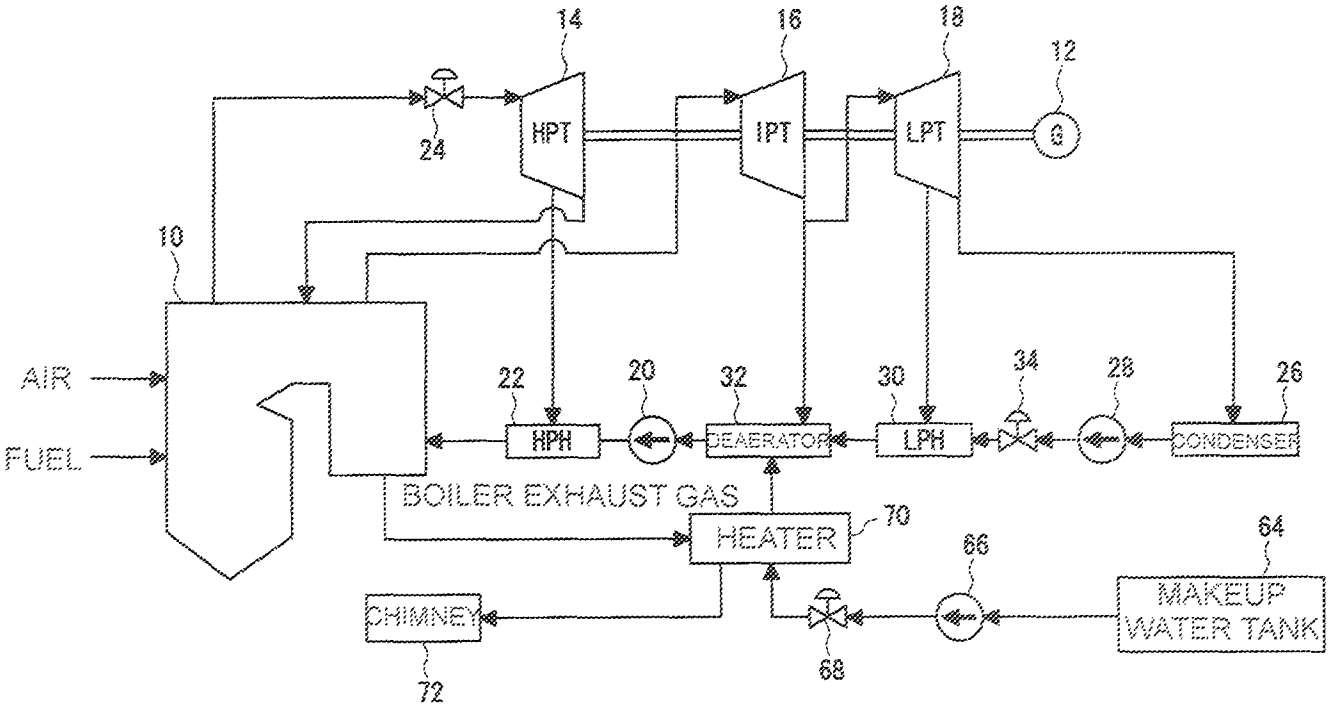
FIG. 8 is an overall configuration diagram showing a first modification of a power plant.

In a first modification of the power plant shown in FIG. 8, the makeup water supplying unit comprises a makeup water tank 64 which supplies makeup water to the deaerator 32, a makeup water pump 66, a makeup water flow rate control valve 68 which performs flow rate control of the makeup water, and a makeup water heater 70 which heats the makeup water. An existing device can be used as the makeup water tank 64. Alternatively, a desalination device tank can be used instead of the makeup water tank 64. The makeup water flow rate control valve 68 may be an ON/OFF valve.

Boiler exhaust gas that is extracted from an exhaust gas port of the boiler 10 or an exhaust gas line to a chimney 72 is introduced into the makeup water heater 70, whereby the makeup water heater 70 heats the makeup water using the boiler exhaust gas.

Figure 9:
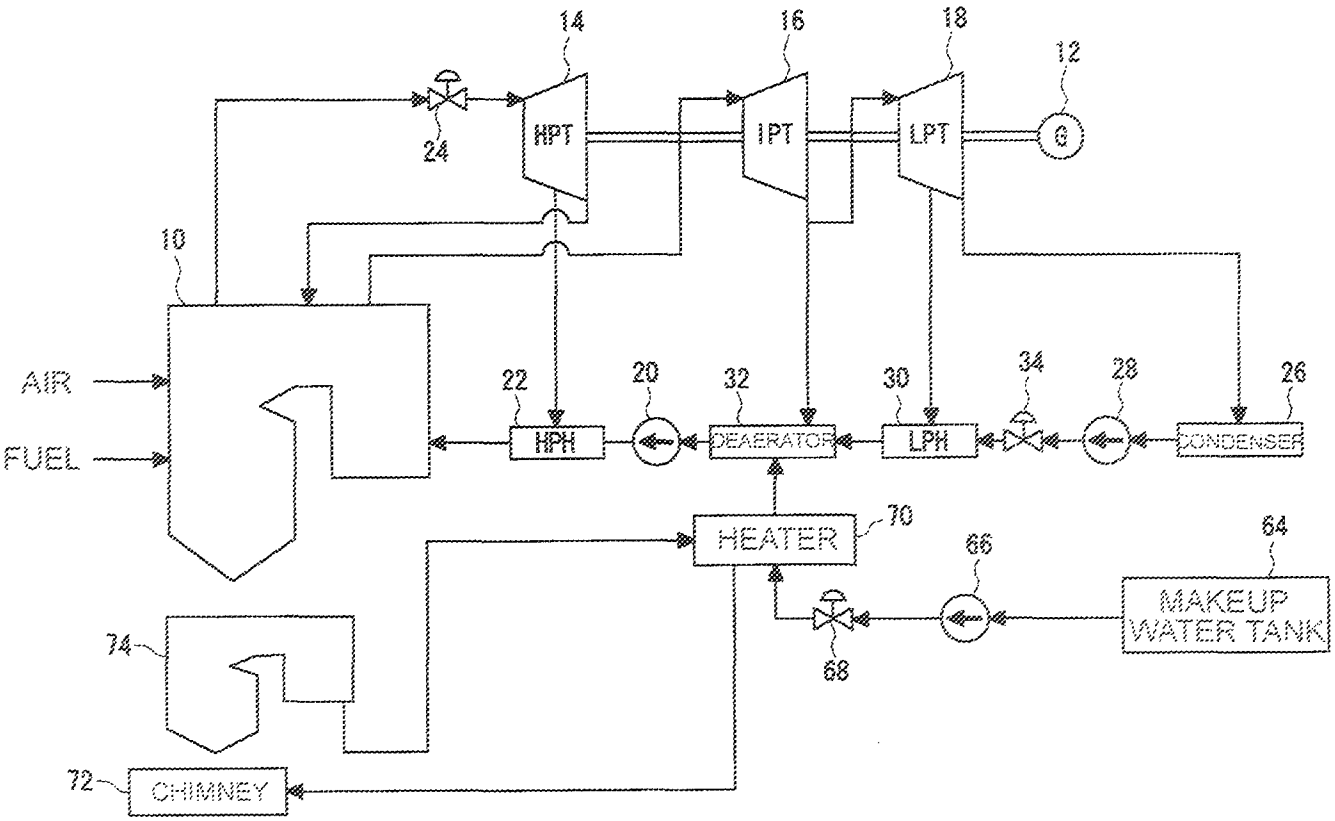
FIG. 9 is an overall configuration diagram showing a second modification of a power plant.
Figure 10:
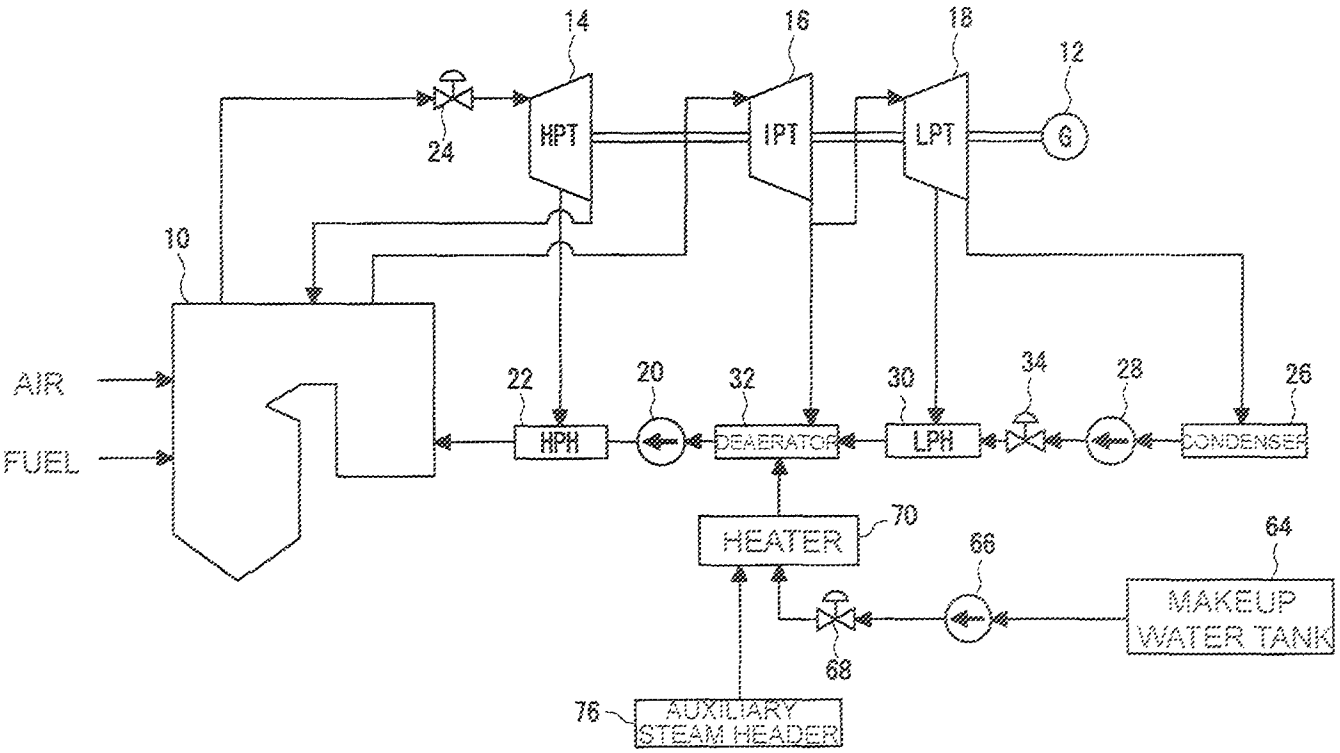
FIG. 10 is an overall configuration diagram showing a third modification of a power plant.
Figure 11:
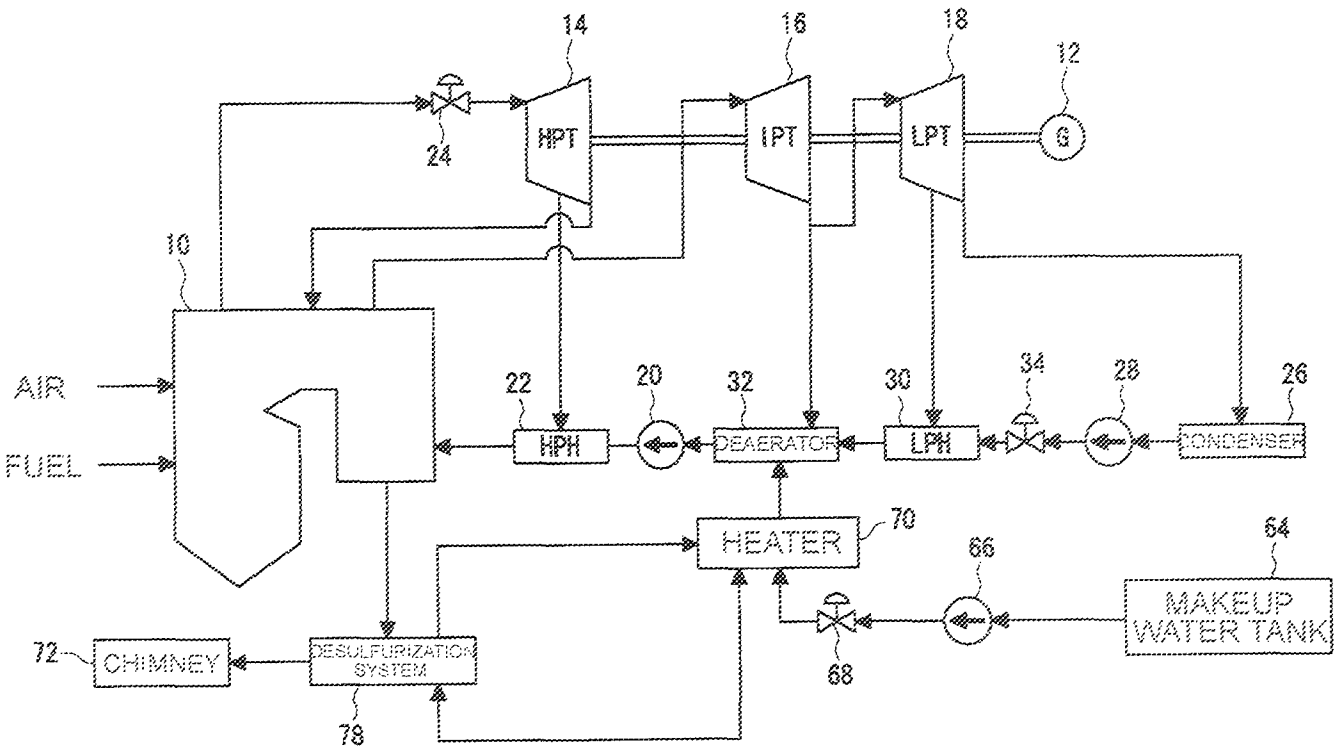
FIG. 11 is an overall configuration diagram showing a fourth modification of a power plant.

As a heating source of the makeup water used by the makeup water heater 70, exhaust gas of a house boiler 74 as used in a second modification shown in FIG. 9, steam of an auxiliary steam system such as an auxiliary steam header 76 as used in a third modification shown in FIG. 10, or exhaust gas in a desulfurization system 78 as used in a fourth modification shown in FIG. 11 may be used besides the boiler exhaust gas.

With the makeup water supplying unit configured as described above, when the water level inside the deaerator 32 drops, the makeup water is supplied to the deaerator 32 from the makeup water tank 64 by the makeup water pump 66. At this point, the makeup water is arranged such that a supply amount set in advance by the makeup water flow rate control valve 68 is supplied to the deaerator 32. Alternatively, a threshold of the water level inside the deaerator 32 may be set in advance, whereby the makeup water is supplied by the makeup water supplying unit once a detected value of the water level detected by a water level detecting unit (not shown) of the deaerator 32 equals or drops below the threshold.

As shown, by comprising the makeup water supplying unit which supplies makeup water to the deaerator 32 in accordance with the water level of the deaerator 32, even when the water level inside the deaerator 32 drops due to water level control of the deaerator 32 in response to a frequency fluctuation or a requested load change, the boiler 10 can be operated in a stable manner due to the makeup water being supplied to the deaerator 32 by the makeup water supplying unit.

Figure 12:
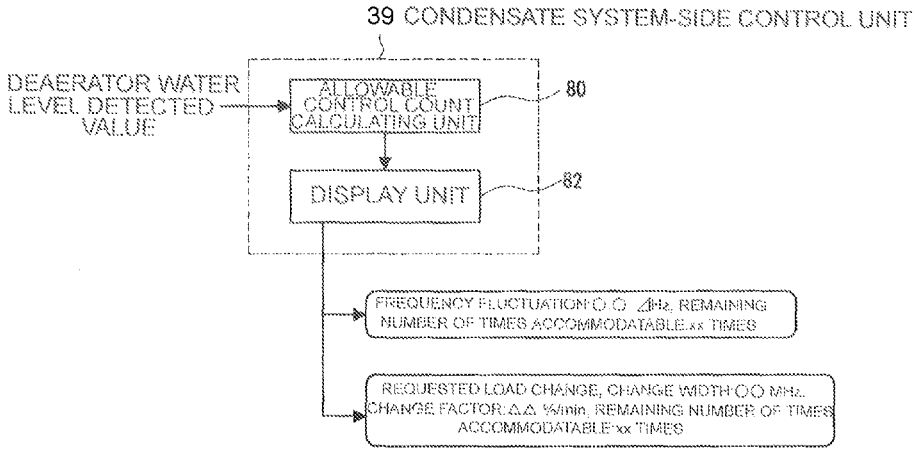
FIG. 12 is a diagram describing a display function according to the first embodiment of the present invention.

In addition, the condensate system-side control unit 39 according to the present embodiment may comprise the configuration shown in FIG. 12 in addition to the configuration described above.

The condensate system-side control unit 39 comprises an allowable control count calculating unit 80 and a display unit 82. First, a detected value of the water level detected by the water level detecting unit is inputted to the allowable control count calculating unit 80. In accordance with an estimated value of a frequency fluctuation or a requested load change which is estimated to be inputted and the detected value of the water level, the allowable control count calculating unit 80 calculates an allowable number of times (a remaining number of times) of deaerator water level control with respect to the frequency fluctuation or the requested load change. In addition, the allowable control count calculating unit 80 outputs a calculation result to the display unit 82.

The display unit 82 is constituted by, for example, a liquid crystal monitor or a CRT monitor and displays the calculation result of the allowable control count calculating unit 80. For example, the display unit 82 displays "Frequency fluctuation: O.O Hz, remaining number of times accommodatable: xx times".

This display means that, with respect to a frequency fluctuation at O.O Hz, the number of times the deaerator water level control can be accommodated is xx times.

In addition, as another example, the display unit 82 displays "Requested load change, change width: OO MHz, rate of change: ΔΔ %/min, remaining number of times accommodatable: xx times". This display means that, with respect to a requested load change with a change width of OO MHz and a rate of change of ΔΔ %/min, the number of times the deaerator water level control can be accommodated is xx times.

Accordingly, a plant worker (manager) can obtain a good indication of whether or not the deaerator water level control should be performed. For example, by manually operating a switch in accordance with a determination result, the plant worker can have the control device 36 perform the deaerator water level control.

Second Embodiment

Next, a control device according to a second embodiment of the present invention will be described.

Figure 13:
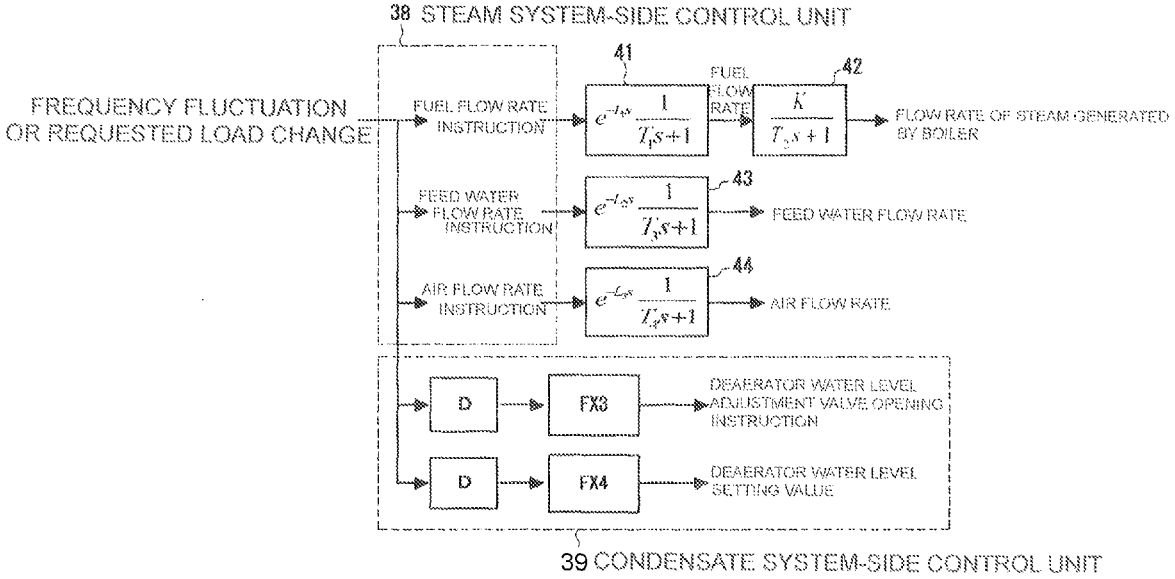
FIG. 13 is a specific configuration diagram of a control device according to a second embodiment of the present invention.
Figure 14:
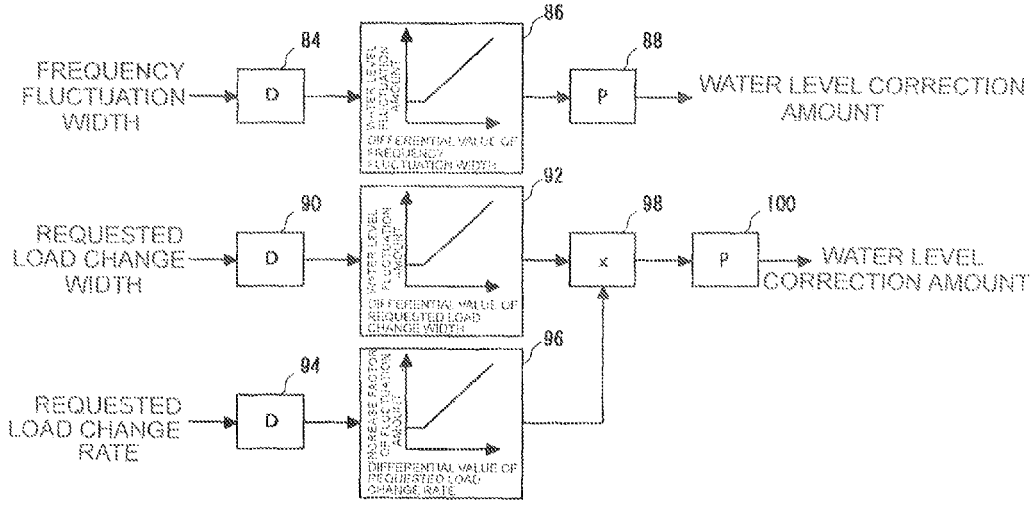
FIG. 14 is a diagram showing a configuration example of a water level adjustment unit in the control device according to the second embodiment of the present invention.

FIG. 13 is a specific configuration diagram of the control device 36 according to the second embodiment of the present invention, and FIG. 14 is a diagram showing a configuration example of the condensate system-side control unit 39 in the control device 36 according to the second embodiment of the present invention. Moreover, for the second embodiment, only configurations which differ from the first embodiment above will be described.

In the second embodiment, the condensate system-side control unit 39 calculates a differential value of a frequency fluctuation width or a differential value of a requested load change, and calculates a new setting value of the water level based on the differential value of the frequency fluctuation width or the differential value of the requested load change.

Specifically, the condensate system-side control unit 39 comprises a differentiator 84 which differentiates a frequency fluctuation width, a table function unit 86 to which a function of a fluctuation amount of the water level in accordance with the differential value of the frequency fluctuation width is set in advance, and a correction function unit 88 which corrects the fluctuation amount of the water level in accordance with the deaerator 32.

Moreover, in the table function unit 86, the fluctuation amount of the water level is set so as to cause the amount of bleed steam of the steam turbine to vary in a direction that suppresses corresponding frequency fluctuation.

In the configuration described above, a frequency fluctuation width is inputted to the differentiator 84 and the differentiator 84 calculates and outputs a differential value of the frequency fluctuation width. The differential value of the frequency fluctuation width is inputted to the table function unit 86, and the table function unit 86 calculates and outputs a fluctuation amount of the water level of the deaerator 32 based on the differential value of the frequency fluctuation width. The fluctuation amount of the water level is inputted to the correction function unit 88, and the correction function unit 88 multiples the fluctuation amount of the water level by an appropriate factor such as −1, and outputs the obtained product as a correction amount of the water level.

When the correction function unit 88 outputs the correction amount of the water level, an opening instruction is outputted to the deaerator water level adjustment valve 34 in a similar manner to the first embodiment.

In addition, the condensate system-side control unit 39 comprises a differentiator 90 which differentiates a requested load change width, a table function unit 92 to which a function of a fluctuation amount of the water level in accordance with a differential value of the requested load change width is set in advance, a differentiator 94 which differentiates a requested load change rate, a table function unit 96 to which a function of an increase factor of a fluctuation amount of the water level in accordance with a differential value of the requested load change rate is set in advance, a multiplier 98 which multiplies outputs of the table function units 92 and 96, and a correction function unit 100 which corrects the water level in accordance with the deaerator 32.

Moreover, in the table function unit 92, the fluctuation amount of the water level is set so as to cause the amount of bleed steam of the steam turbine to vary in a direction in which the output of the generator 12 conforms to a corresponding load change.

In the configuration described above, a requested load change width is inputted to the differentiator 90 and the differentiator 90 calculates and outputs a differential value of the requested load change width. The differential value of the requested load change width is inputted to the table function unit 92, and the table function unit 92 calculates and outputs a fluctuation amount of the water level of the deaerator 32 based on the differential value of the requested load change width.

On the other hand, a requested load change rate is inputted to the differentiator 94 and the differentiator 94 calculates and outputs a differential value of the requested load change rate. The differential value of the requested load change rate is inputted to the table function unit 96, and the table function unit 96 calculates and outputs an increase factor of a fluctuation amount of the water level of the deaerator 32 based on the differential value of the requested load change rate.

The fluctuation amount of the water level and the increase factor of the fluctuation amount outputted from the table function unit 92 and the table function unit 96 are inputted to the multiplier 98, and the multiplier 98 multiplies the fluctuation amount of the water level by the increase factor and outputs an obtained product as a fluctuation amount of the water level. The fluctuation amount of the water level is inputted to the correction function unit 100, and the correction function unit 100 multiples the fluctuation amount of the water level by a correction factor and outputs the obtained product as a correction amount of the water level.

When the correction function unit 100 outputs the correction amount of the water level, an opening instruction is outputted to the deaerator water level adjustment valve 34 in a similar manner to the first embodiment.

Moreover, while an opening instruction is outputted based on a new setting value of the water level both in a case where a frequency fluctuation is inputted and a case where a requested load change is inputted in the present embodiment, an opening instruction may be arranged so as to be outputted based on a new setting value of the water level only in any one of the cases.

In addition, when a requested load change is inputted, only one of a requested load change width and a requested load change rate may be arranged so as to be inputted. In this case, for example, the table function unit 96 may be omitted and the fluctuation amount of the water level outputted by the table function unit 92 may be directly inputted to the correction function unit 100. Alternatively, the table function unit 92 may be omitted and, at the same time, another table function unit which outputs a fluctuation amount of the water level based on the differential value of the inputted requested load change rate may be used instead of the table function unit 96. In addition, the fluctuation amount of the water level outputted by the other table function unit may be directly to the correction function unit 100.

According to the present second embodiment, the control device 36 which executes the condensate flow rate control only when a frequency fluctuation or a requested load change varies abruptly can be realized.

Third Embodiment

Next, the control device 36 according to a third embodiment of the present invention will be described.

Figure 15:
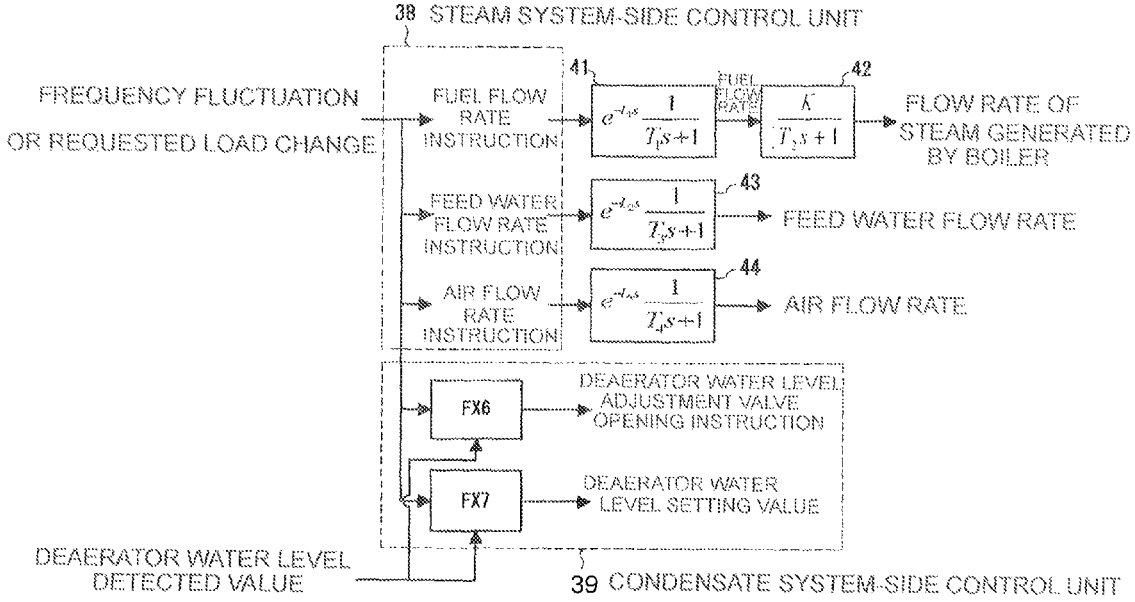
FIG. 15 is a specific configuration diagram of a control device according to a third embodiment of the present invention.
Figure 16:
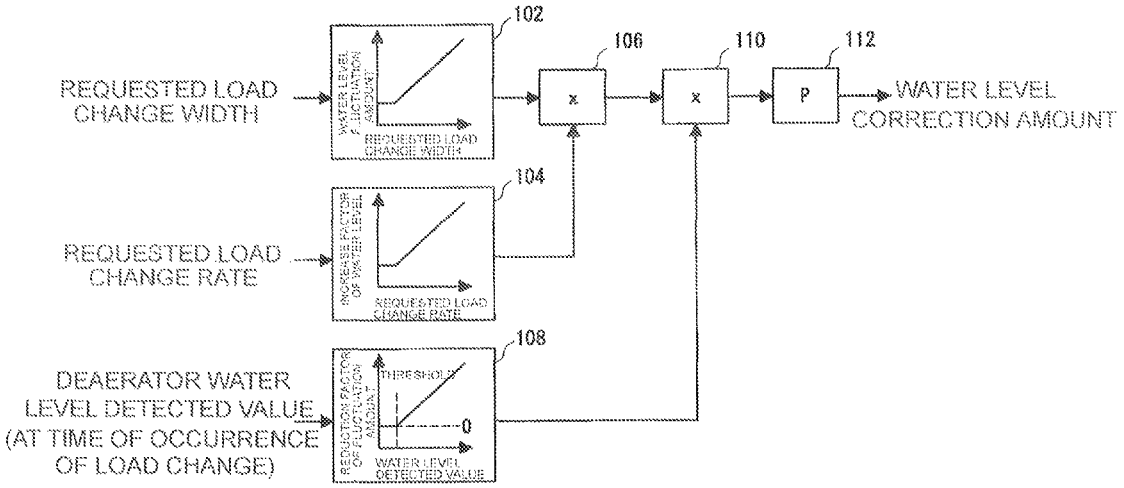
FIG. 16 is a diagram showing a configuration example of a water level adjustment unit in the control device according to the third embodiment of the present invention.

FIG. 15 is a specific configuration diagram of the control device 36 according to the third embodiment of the present invention, and FIG. 16 is a diagram showing a configuration example of the condensate system-side control unit 39 in the control device 36 according to the third embodiment of the present invention. Moreover, for the present third embodiment, only configurations which differ from the first and second embodiments above will be described.

In the third embodiment, a detected value of the water level of the deaerator 32 at a moment of occurrence t0 (refer to FIG. 6) of a frequency fluctuation or a requested load change is inputted to the condensate system-side control unit 39. In addition, when the inputted detected value of the water level is lower than a threshold set in advance, the condensate system-side control unit 39 either disables and does not execute the condensate flow rate control or executes the condensate flow rate control while further adjusting the setting value of the water level.

A case where a requested load change is used will be described as an example.

The condensate system-side control unit 39 comprises a table function unit 102 to which a function of a fluctuation amount of the water level in accordance with a requested load change width is set in advance, a table function unit 104 to which a function of an increase factor of a fluctuation amount of the water level in accordance with a requested load change rate is set in advance, a multiplier 106 which multiplies an output of the table function unit 102 by an output of the table function unit 104, a table function unit 108 to which a reduction factor of a fluctuation amount of the water level in accordance with a detected value of the water level of the deaerator at a moment of occurrence of a requested load change is set in advance, a multiplier 110 which multiplies an output of the multiplier 106 by an output of the table function unit 108, and a correction function unit 112 which multiplies an output of the multiplier 110 by an appropriate factor in accordance with the deaerator 32.

In the configuration described above, the requested load change is inputted to the table function unit 102, and the table function unit 102 calculates and outputs a fluctuation amount of the water level of the deaerator 32 based on the requested load change. Meanwhile, the requested load change rate is inputted to the table function unit 104, and the table function unit 104 calculates and outputs an increase factor of the fluctuation amount of the water level based on the requested load change rate.

The fluctuation amount of the water level and the increase factor of the fluctuation amount respectively outputted from the table function unit 102 and the table function unit 104 are inputted to the multiplier 106, and the multiplier 106 multiplies the fluctuation amount of the water level by the increase factor and outputs an obtained product as a fluctuation amount of the water level.

In addition, the detected value of the water level of the deaerator 32 at the moment of occurrence of the requested load change is inputted to the table function unit 108, and the table function unit 108 calculates and outputs a reduction factor of a fluctuation amount of the water level based on the detected value of the water level of the deaerator 32 at the moment of occurrence of the requested load change.

The reduction factor of the fluctuation amount of the water level ranges between, for example, 0 and 1, and 0 is assigned as the reduction factor to detected values equal to or below a threshold. In addition, when the detected value of the water level exceeds the threshold, the reduction factor is incremented as the detected value increases.

The fluctuation amount of the water level outputted by the multiplier 106 and the reduction factor of the fluctuation amount of the water level outputted by the table function unit 108 are inputted to the multiplier 110. The multiplier 110 multiplies the fluctuation amount of the water level by the reduction factor and outputs an obtained product as a fluctuation amount of the water level. The fluctuation amount of the water level outputted by the multiplier 110 is inputted to the correction function unit 112, and the correction function unit 112 multiples the inputted fluctuation amount of the water level by a factor such as −1 and outputs an obtained product as a correction amount of the water level.

When the correction function unit 112 outputs the correction amount of the water level, an opening instruction is outputted to the deaerator water level adjustment valve 34 in a similar manner to the first embodiment.

According to the present third embodiment, the water level of the deaerator 32 can be prevented from dropping below a threshold and the power plant can be operated in a stable manner.

Moreover, the threshold of the water level may be a lower limit (a warning level) of the water level or a numerical value that is obtained by adding a certain margin to the lower limit.

Fourth Embodiment

Next, the control device 36 according to a fourth embodiment of the present invention will be described.

FIG. 15 is a specific configuration diagram of the control device 36 according to the fourth embodiment of the present invention, and FIG. 16 is a diagram showing a configuration example of the condensate system-side control unit 39 in the control device 36 according to the fourth embodiment of the present invention. Moreover, for the present fourth embodiment, only configurations which differ from the first to third embodiments above will be described.

In the fourth embodiment, the condensate system-side control unit 39 calculates a deviation (an output deviation) between an instruction final value of a requested load in a requested load change (power output final target value) and a power output value, and at a moment where the deviation equals or falls below a threshold set in advance as a return condition, the return unit 63 returns an opening instruction of the deaerator water level adjustment valve 34 and a setting value of the water level of the deaerator 32 to setting values prior to adjustment by the water level adjustment unit 40.

Figure 17:
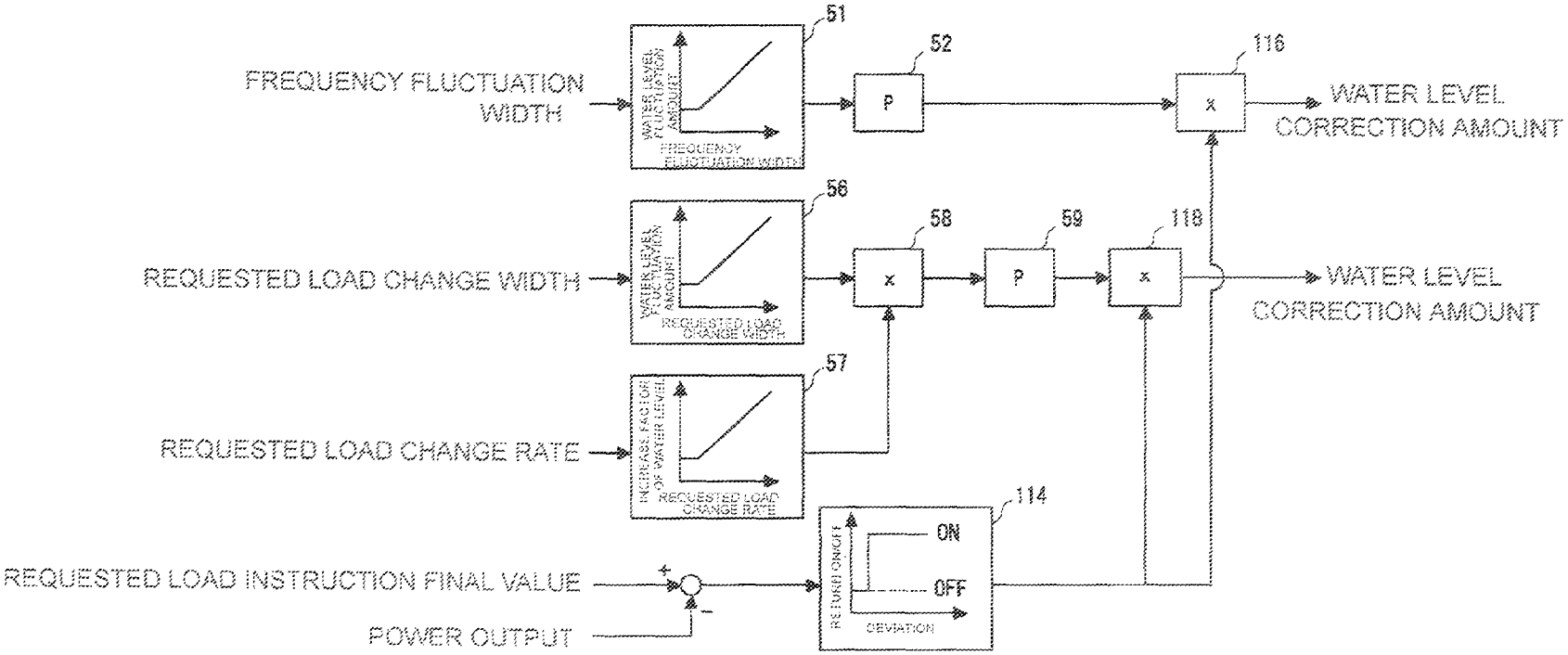
FIG. 17 is a diagram showing a configuration example of a water level adjustment unit and a return unit in a control device according to a fourth embodiment of the present invention.

To this end, as shown in FIG. 17, the condensate system-side control unit 39 according to the fourth embodiment further comprises a table function unit 114 and multipliers 116 and 118 as the return unit 63 in comparison to the first embodiment.

A function of water level return ON/OFF with respect to a power output deviation is set in advance to the table function unit 114. With the table function unit 114, for example, 0 is assigned as OFF to deviations equal to or below the threshold, and 1 is assigned as ON to deviations exceeding the threshold.

A value indicating water level return ON/OFF outputted from the table function unit 114 and a fluctuation amount of the water level outputted from the correction function unit 52 are inputted to the multiplier 116. The multiplier 116 multiplies the fluctuation amount of the water level by the value indicating water level return ON/OFF, and outputs an obtained product as the correction amount of the water level.

In addition, the value indicating water level return ON/OFF outputted from the table function unit 114 and a fluctuation amount of the water level outputted from the correction function unit 59 are inputted to the multiplier 118. The multiplier 118 multiplies the fluctuation amount of the water level by the value indicating water level return ON/OFF, and outputs an obtained product as the correction amount of the water level.

In the fourth embodiment, the output deviation between the instruction final value of the requested load in the requested load change (power output final target value) and the power output value is calculated, and the output deviation is inputted to the table function unit 114. When the inputted output deviation is equal to or below the threshold, the table function unit 114 outputs 0. Therefore, the correction amount of the water level becomes 0, and the opening instruction of the deaerator water level adjustment valve 34 and the setting value of the water level of the deaerator 32 are returned to setting values prior to adjustment by the water level adjustment unit 40.

Since the control device 36 according to the fourth embodiment adopts a configuration in which the output deviation between the instruction final value of the requested load and the power output value is monitored and the setting value of the water level is returned to a setting value prior to adjustment when the output deviation equals or falls below a threshold set in advance, excessive power output can be prevented.

Figure 18A:
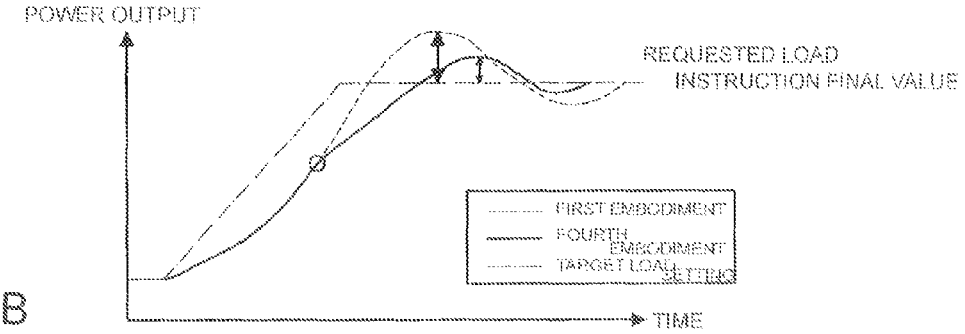
FIG. 18A is a graph describing how power output conforms to a target load setting according to the fourth embodiment.
Figure 18B:
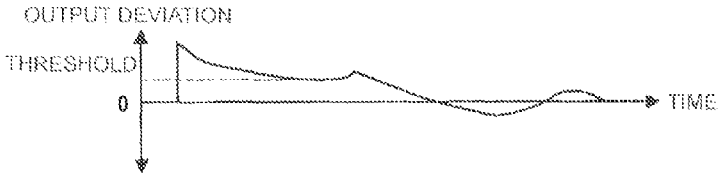
FIG. 18B is a graph describing a change over time in output deviation according to the fourth embodiment.

FIG. 18 is a graph describing how power output conforms to a target load setting when the water level is restored using the output deviation. FIG. 18A shows a change over time of the power output, and FIG. 18B shows a change over time of the output deviation together with the threshold.

A line representing the first embodiment in FIG. 18 indicates a change over time of the power output by the control device 36 according to the first embodiment. In this case, the return unit 63 which performs return control based on elapsed time is used. A line representing the fourth embodiment in FIG. 18 indicates a change over time of the power output by the control device 36 according to the fourth embodiment. In this case, the return unit 63 which performs the return control based on the output deviation is used.

As is apparent from FIG. 18, with the control device 36 according to the fourth embodiment, excessive power output can be prevented by restoring the water level based on the output deviation.

Moreover, in a water level return process, the opening instruction of the deaerator water level adjustment valve 34 and the setting value of the water level of the deaerator 32 are favorably returned to initial values either in stages as shown in FIGS. 5A and 7A or at a constant rate of change as shown in FIGS. 5B and 7B. Accordingly, destabilization of operation due to an abrupt output change can be prevented and the power plant can be operated in a stable manner.

Fifth Embodiment

Next, the control device 36 according to a fifth embodiment of the present invention will be described.

Figure 19:
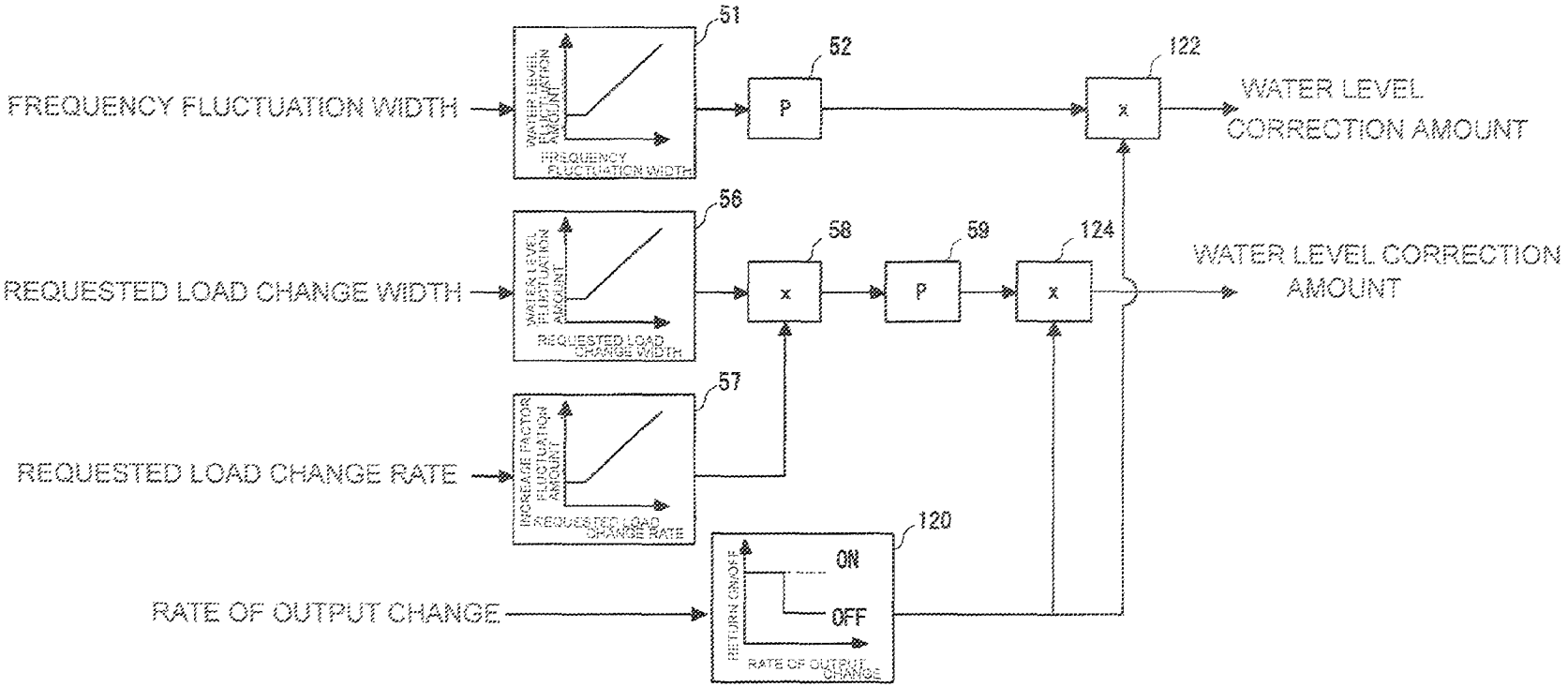
FIG. 19 is a diagram showing a configuration example of a water level adjustment unit and a return unit in a control device according to a fifth embodiment of the present invention.

FIG. 19 is a diagram showing a configuration example of the condensate system-side control unit 39 in the control device 36 according to the fifth embodiment of the present invention. Moreover, for the fifth embodiment, only configurations which differ from the first to fourth embodiments above will be described.

In the fifth embodiment, the condensate system-side control unit 39 calculates a rate of change of power output (rate of output change), and at a moment where the rate of change of power output equals or exceeds a threshold set in advance as a return condition, the return unit 63 returns an opening instruction of the deaerator water level adjustment valve 34 and a setting value of the water level of the deaerator 32 to setting values prior to adjustment by the water level adjustment unit 40.

To this end, in the fifth embodiment, the condensate system-side control unit 39 comprises a table function unit 120 and multipliers 122 and 124 in place of the table function unit 114 and the multipliers 116 and 118 according to the fourth embodiment.

A function of water level return ON/OFF with respect to a rate of output change is set in advance to the table function unit 120. With the table function unit 120, for example, 1 is assigned as ON to rates of output change which are below a threshold, and 0 is assigned as OFF to rates of output change which are equal or exceed the threshold.

A value indicating water level return ON/OFF outputted from the table function unit 120 and a fluctuation amount of the water level outputted from the correction function unit 52 are inputted to the multiplier 122. The multiplier 116 multiplies the fluctuation amount of the water level by the value indicating water level return ON/OFF, and outputs an obtained product as the correction amount of the water level.

In addition, the value indicating water level return ON/OFF outputted from the table function unit 120 and a fluctuation amount of the water level outputted from the correction function unit 59 are inputted to the multiplier 124. The multiplier 124 multiplies the fluctuation amount of the water level by the value indicating water level return ON/OFF, and outputs an obtained product as the correction amount of the water level.

In the fifth embodiment, a rate of output change is calculated and inputted to the table function unit 120. When the inputted rate of output change equals or exceeds the threshold, the table function unit 120 outputs 0. Therefore, the correction amount of the water level becomes 0, and the opening instruction of the deaerator water level adjustment valve 34 and the setting value of the water level of the deaerator 32 are returned to setting values prior to adjustment by the water level adjustment unit 40.

Since the control device 36 according to the fifth embodiment adopts a configuration in which the rate of output change is monitored and the setting value of the water level is returned to a setting value prior to adjustment when the rate of output change equals or exceeds a threshold set in advance, excessive power output can be prevented.

According to the present fifth embodiment, a configuration can be adopted in which the condensate flow rate control is only adapted when a frequency fluctuation or a requested load change varies abruptly.

Figure 20A:
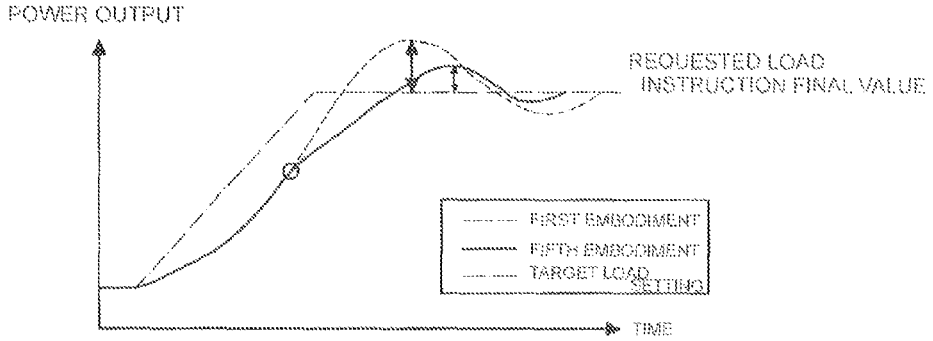
FIG. 20A is a graph describing how power output conforms to a target load setting according to the fifth embodiment.
Figure 20B:
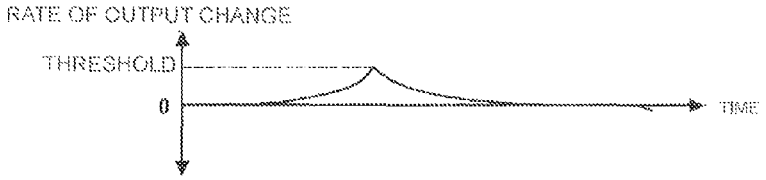
FIG. 20B is a graph describing a change over time in a rate of output change according to the fifth embodiment.

FIG. 20 is a graph describing how power output conforms to a target load setting when the water level is restored using a rate of output change. FIG. 20A shows a change over time of the power output, and FIG. 20B shows a change over time of the rate of output change together with the threshold.

A line representing the first embodiment in FIG. 20 indicates a change over time of the power output when the control device 36 according to the first embodiment is used. In this case, the return unit 63 which performs return control based on elapsed time is used. A line representing the fifth embodiment in FIG. 20 indicates a change over time of the power output when the control device 36 according to the fifth embodiment is used. In this case, the return unit 63 which performs the return control based on the rate of output change is used.

As is apparent from FIG. 20, by restoring the water level based on the rate of output change, excessive power output can be prevented.

Sixth Embodiment

Next, the control device 36 according to a sixth embodiment of the present invention will be described.

Figure 21:
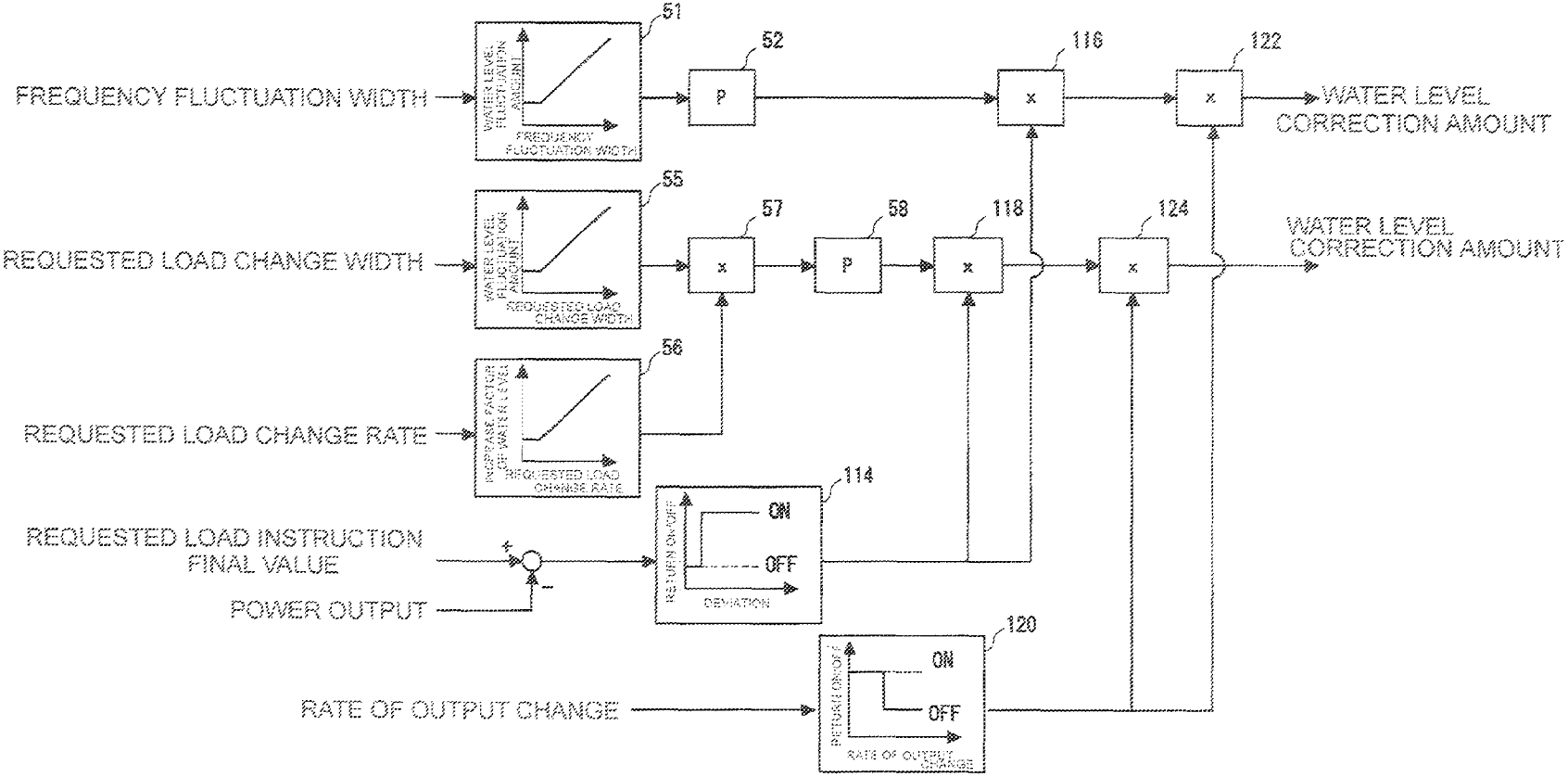
FIG. 21 is a diagram showing a configuration example of a water level adjustment unit and a return unit in a control device according to a sixth embodiment of the present invention.

FIG. 21 is a diagram showing a configuration example of the condensate system-side control unit 39 in the control device 36 according to the sixth embodiment of the present invention. Moreover, for the sixth embodiment, only configurations which differ from the first to fifth embodiments above will be described.

As is shown in FIG. 21, the sixth embodiment combines the fourth embodiment and fifth embodiment described above with each other, and executes return control based on both an output deviation and a rate of output change. Therefore, in the sixth embodiment, an output of the multiplier 116 is inputted to the multiplier 122 and an output of the multiplier 118 is inputted to the multiplier 124.

FIG. 22 is a graph describing how output conforms to a target load setting when the water level is restored using an output deviation and a rate of output change. FIG. 22A shows a change over time of power output, and FIG. 22B shows a change over time of the output deviation and the rate of output change together with the threshold.

A line representing the fourth embodiment in FIG. 22 indicates a change over time of the power output by the control device 36 according to the fourth embodiment. In this case, the return unit 63 which performs the return control based on the output deviation is used. A line representing the sixth embodiment in FIG. 22 indicates a change over time of power output by the control device 36 according to the sixth embodiment. In this case, the return unit 63 which performs the return control based on the output deviation and the change over time is used.

As shown in FIG. 22, in the sixth embodiment, the rate of output change reaches the threshold before the output deviation does. Therefore, in the sixth embodiment, the return control is executed earlier than in the fourth embodiment and excessive power output is more reliably prevented.

Seventh Embodiment

Next, the control device 36 according to a seventh embodiment of the present invention will be described. Moreover, for the seventh embodiment, only configurations which differ from the first to sixth embodiments above will be described.

In the seventh embodiment, the allowable control count calculating unit 80 computes a remaining number of times the condensate flow rate control can be executed for each of a plurality of estimated values of frequency fluctuations and requested load changes which are estimated to be inputted, and the display unit 82 displays a computation result as shown in FIG. 23.

Moreover, FIG. 23 also displays a setting value of the water level of the deaerator 32 when the condensate flow rate control is executed. However, a field of the setting value of the water level displays a result of calculation performed by assigning a detected value of the water level to x.

Figure 24:
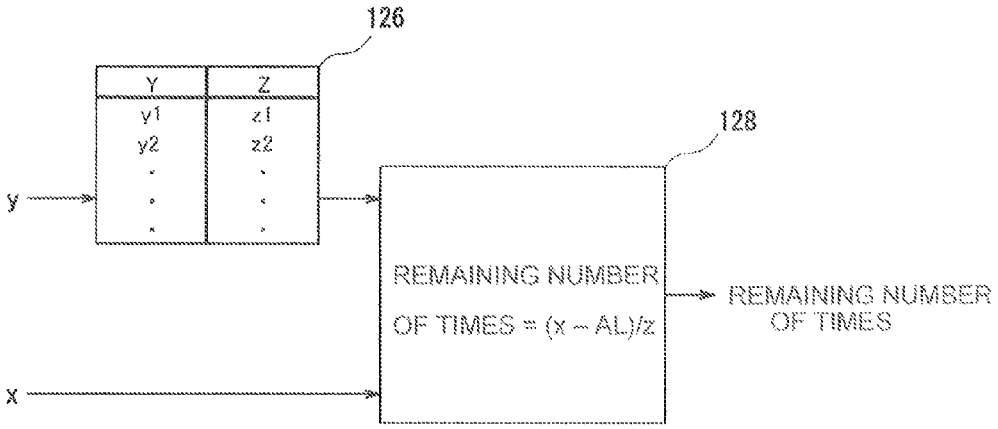
FIG. 24 is a diagram describing a part of a configuration of an allowable control count calculating unit included in the control device according to the seventh embodiment of the present invention.
Figure 25:
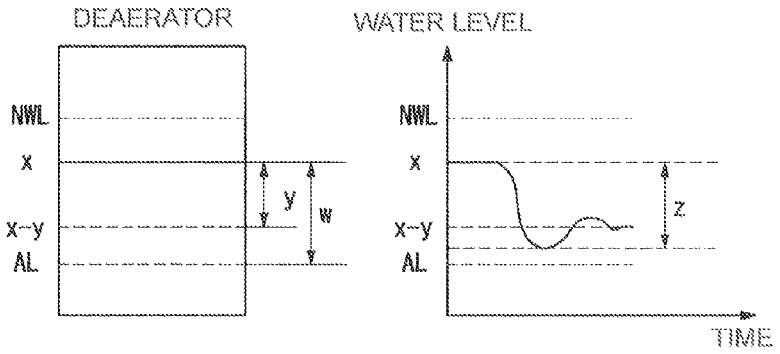
FIG. 25 is a diagram for describing a calculation method executed by the allowable control count calculating unit included in the control device according to the seventh embodiment of the present invention.

FIG. 24 is a diagram showing a part of a configuration of the allowable control count calculating unit 80 and FIG. 25 is a diagram for describing a method of computing the remaining number of times.

Due to a configuration similar to that of the water level adjustment unit 40, the allowable control count calculating unit 80 computes a fluctuation amount y of the water level based on an estimated value of a frequency fluctuation or a requested load change. In addition, the allowable control count calculating unit 80 comprises a table function unit 126 to which is set a function of a maximum value z of the fluctuation amount of the water level relative to the fluctuation amount y of the water level. When the fluctuation amount y of the water level is inputted, the table function unit 126 outputs a corresponding maximum value z of the fluctuation amount of the water level. As shown in FIG. 24, the maximum value z is a sum of the fluctuation amount y of the water level and an overshoot created by the condensate flow rate control.

Furthermore, the allowable control count calculating unit 80 comprises a remaining count computing unit 128. The maximum value z of the fluctuation amount outputted by the table function unit 126 and a present water level x are inputted to the remaining count computing unit 128. The remaining count computing unit 128 computes $(x-AL)/z$, truncates a computation result to the nearest whole number, and outputs a truncated result as the remaining number of times. Moreover, AL denotes a warning water level as a lower limit. According to the remaining count computing unit 128, the remaining number of times is set so that the water level does not fall below the warning water level when the condensate flow rate control is executed.

With the control device 36 according to the seventh embodiment, a manager of a power plant can instantaneously make a decision on whether or not a frequency fluctuation or a requested load change can be accommodated by the condensate flow rate control executed by the water level adjustment unit 40. In particular, since the remaining number of times is displayed for each of a plurality of estimated values of frequency fluctuations or requested load changes, the manager of the power plant can instantaneously make a decision on whether or not each frequency fluctuation size or each requested load change size can be accommodated by executing the condensate flow rate control. In addition, based on a determination result, the manager of a power plant can have the control device 36 execute the deaerator water level control in accordance with a desired estimated value by, for example, manually operating a switch.

Furthermore, with the control device 36 according to the seventh embodiment, since gain is high when the controllers 55 and 62 perform proportional control and the remaining number of times is computed so that the water level does not fall below the warning water level even when an overshoot of the water level is significant, the power plant can be operated in a stable manner.

Figure 26:
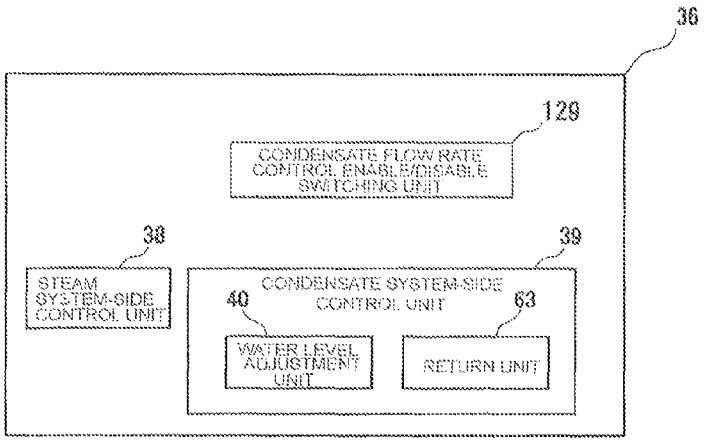
FIG. 26 is a diagram for describing a condensate flow rate control enable/disable switching unit included in the control device according to the seventh embodiment of the present invention.

Favorably, as shown in FIG. 26, the control device 36 according to the seventh embodiment further comprises an enable/disable switching unit 129 which either enables or disables the condensate flow rate control. For example, the enable/disable switching unit 129 is constituted by a switch such as a push-button switch which is operated by the manager of the power plant. The manager can permit the condensate flow rate control to be executed by setting the switch to enable and prohibit the condensate flow rate control from being executed by setting the switch to disable.

In addition, favorably, when the remaining number of times of the condensate flow rate control is zero, the enable/disable switching unit 129 forcibly switches the setting of the switch to disable and prohibits the condensate flow rate control from being executed even when the switch is set to enable.

According to this configuration, the condensate flow rate control is prohibited from being executed when the remaining number of times is zero regardless of the setting of the switch. Accordingly, the condensate flow rate control can be prevented from being erroneously executed and the power plant can be operated in a stable manner.

Eighth Embodiment

Next, the control device 36 according to an eighth embodiment of the present invention will be described. Moreover, for the eighth embodiment, only configurations which differ from the first to seventh embodiments above will be described.

The eighth embodiment differs from the first to seventh embodiments in that the water level adjustment unit 40 executes the condensate flow rate control so as to target an amount of feed water stored in the deaerator water storage tank of the deaerator 32 (holding water amount) instead of the water level of the deaerator 32. Since there is a correlation between the water level of the deaerator 32 and the holding water amount, by replacing the water level with the holding water amount in the first to seventh embodiments, the condensate flow rate control can be readily executed while setting the holding water amount as a control target.

Figure 27:
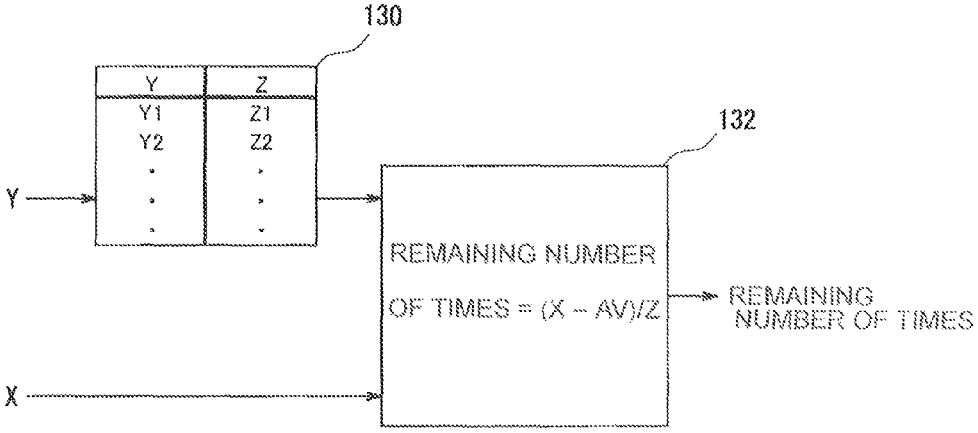
FIG. 27 is a diagram describing a part of a configuration of an allowable control count calculating unit included in a control device according to an eighth embodiment of the present invention.
Figure 28:
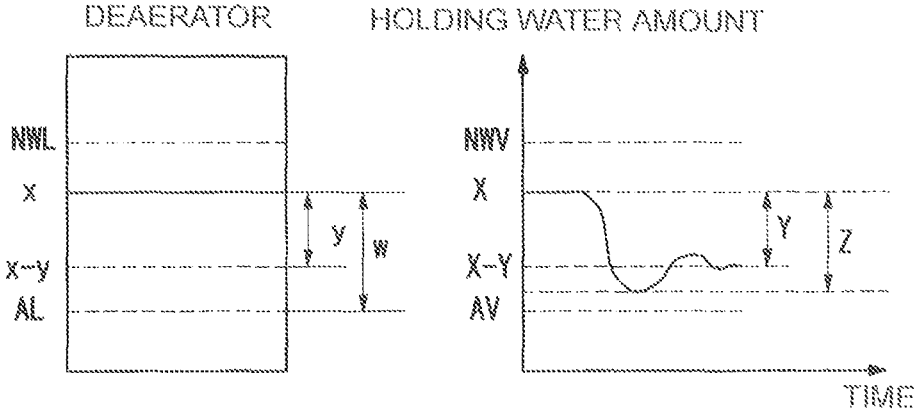
FIG. 28 is a diagram for describing a calculation method executed by the allowable control count calculating unit included in the control device according to the eighth embodiment of the present invention.
Figure 29:
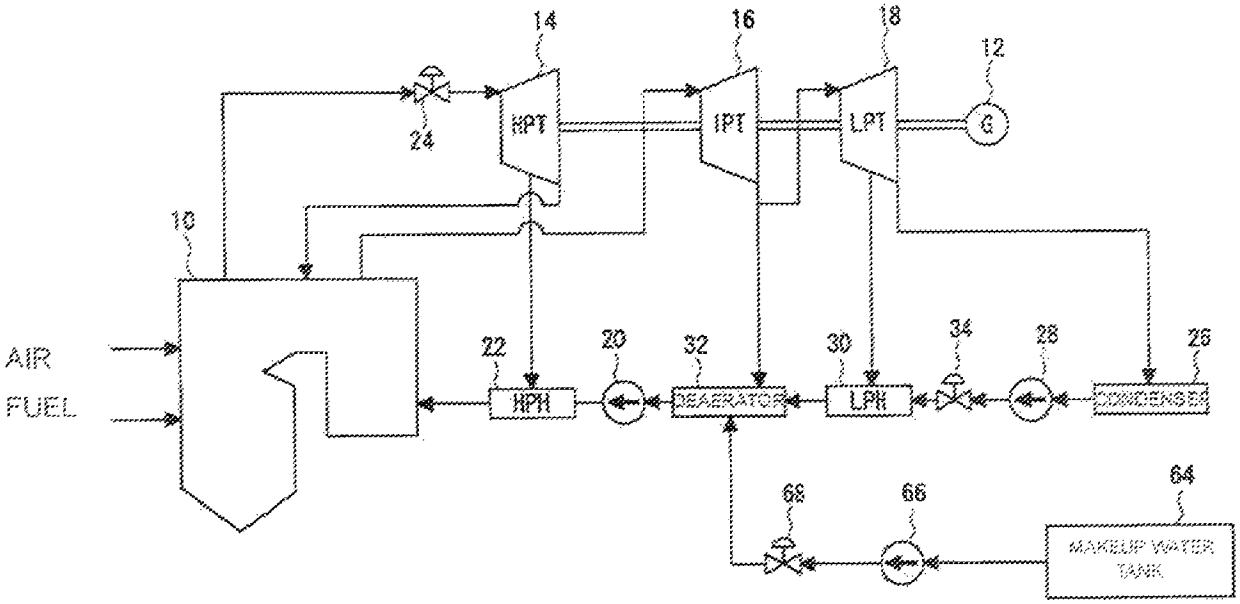
FIG. 29 is an overall configuration diagram of a conventional power plant.

FIG. 26 is a diagram showing a part of a configuration of the allowable control count calculating unit 80 when the condensate flow rate control is executed while setting the holding water amount as the control target, and FIG. 27 is a diagram for describing a method of computing the remaining number of times.

Due to a configuration similar to that of the water level adjustment unit 40, the allowable control count calculating unit 80 computes a fluctuation amount Y of the holding water amount based on an estimated value of a frequency fluctuation or a requested load change. In addition, the allowable control count calculating unit 80 comprises a table function unit 130 to which is set a function of a maximum value Z of the fluctuation amount of the holding water amount relative to the fluctuation amount Y of the holding water amount. When the fluctuation amount Y of the holding water amount is inputted, the table function unit 130 outputs a corresponding maximum value Z of the fluctuation amount of the holding water amount. As shown in FIG. 27, the maximum value Z is a sum of the fluctuation amount Y of the holding water amount and an overshoot created by the condensate flow rate control.

Furthermore, the allowable control count calculating unit 80 comprises a remaining count computing unit 132. The maximum value Z of the fluctuation amount outputted by the table function unit 130 and a present holding water amount X are inputted to the remaining count computing unit 132. The remaining count computing unit 128 computes (X−AV)/Z, truncates a computation result to the nearest whole number, and outputs a truncated result as the remaining number of times. Moreover, AV denotes a warning water amount. According to the remaining count computing unit 132, the remaining number of times is set so that the holding water amount does not fall below the warning water amount when the condensate flow rate control is executed.

With the control device 36 according to the eighth embodiment, the manager of a power plant can instantaneously make a decision on whether or not a frequency fluctuation or a requested load change can be accommodated by the condensate flow rate control executed by the water level adjustment unit 40. In particular, since the remaining number of times is displayed for each of a plurality of estimated values of frequency fluctuations or requested load changes, the manager of the power plant can instantaneously make a decision on whether or not each frequency fluctuation size or each requested load change size can be accommodated by executing the condensate flow rate control.

The present invention is not limited to the first to eighth embodiments described above and can be modified without departing from the spirit and scope of the invention.

For example, the present invention includes modes which are modifications of the first to eighth embodiments and modes which combine components of the first to eighth embodiments as appropriate.

EXPLANATION OF REFERENCE NUMERALS

10 boiler
12 generator
14 high-pressure turbine (steam turbine)
16 intermediate-pressure turbine (steam turbine)
18 low-pressure turbine (steam turbine)
20 feed water pump
22 high-pressure feed water heater
24 governor valve
26 condenser
28 condensate pump
30 low-pressure feed water heater (low-pressure heater)
32 deaerator
34 deaerator water level adjustment valve
36 control device (condensate flow rate control device)
38 steam system-side control unit
39 condensate system-side control unit
40 water level adjustment unit
64 makeup water tank

The invention claimed is:

1. A condensate flow rate control device for a power plant, the power plant having:

a boiler;

a steam turbine configured such that steam generated by the boiler is introduced thereinto;

a generator configured to be driven by the steam turbine;

a condenser configured such that exhaust hot steam from the steam turbine is supplied thereto;

a deaerator water level adjustment valve;

a deaerator configured such that condensate generated by the condenser is supplied via the deaerator water level adjustment valve thereinto and bleed steam from the steam turbine is introduced thereinto;

a condensate flow path extending from the deaerator water level adjustment valve to the deaerator configured such that the condensate is supplied to the deaerator therethrough: and a feed pump configured to supply feedwater deaerated by the deaerator to the boiler, the condensate flow rate control device comprising a water level adjustment unit configured to perform condensate flow rate control such that a frequency fluctuation or a requested load change is inputted into the water level adjustment unit, and the water level adjustment unit adjusts pressure in the condensate flow path and thereby adjusts an amount of bleed steam from the steam turbine so that the inputted frequency fluctuation is suppressed or an output value of the generator conforms to the inputted requested load change, wherein based on a preset relationship between a fluctuation width of a frequency fluctuation or a change width of a requested load change and a change width of a water level or a holding water amount of the deaerator, the water level adjustment unit is configured to calculate a setting value of the water level or a setting value of the holding water amount from the frequency fluctuation or the requested load change and output an opening instruction to the deaerator water level adjustment valve so that the water level or the holding water amount of the deaerator assumes the setting value of the water level or the setting value of the holding water amount;

an allowable control count calculating unit configured to display at least one estimated value of a fluctuation width of a frequency fluctuation or a change width of a requested load change which is estimated to be inputted and compute a remaining number of times the water level adjustment unit can conduct the condensate flow rate control based on the estimated value, a detected value of a water level or a holding water amount of the deaerator, and a lower limit of the water level or the holding water amount of the deaerator; and a display unit configured to display the remaining number of times computed by the allowable control count calculating unit in association with the estimated value.

2. The condensate flow rate control device for a power plant according to claim 1, wherein the power plant comprises a low-pressure heater which is arranged in the condensate flow path, and which is configured such that bleed steam is supplied from the steam turbine thereto and heats the condensate.

3. The condensate flow rate control device for a power plant according to claim 1, further comprising a return unit configured to conduct return control for returning a setting value of the water level, a setting value of the holding water amount, or an opening of the deaerator water level adjustment valve to a setting value prior to the condensate flow rate control by the water level adjustment unit when a predetermined return condition is satisfied.

4. The condensate flow rate control device for a power plant according to claim 3, wherein the return unit is configured to return the setting value of the water level, the setting value of the holding water amount, or the opening of the deaerator water level adjustment valve to a setting value prior to the condensate flow rate control by the water level adjustment unit at a constant rate of change or in stages.

5. The condensate flow rate control device for a power plant according to claim 3, wherein the return unit is configured to calculate a deviation between an instruction final value of a requested load in the requested load change and an output value of the generator, and conduct the return control when the deviation equals or falls below a preset threshold as the return condition.

6. The condensate flow rate control device for a power plant according to claim 3, wherein the return unit is configured to calculate a rate of change of the output value of the generator, and conduct the return control when the rate of change equals or exceeds a preset threshold as the return condition.

7. The condensate flow rate control device for a power plant according to claim 3, wherein the return unit is configured such that a detected value of a water level or a holding water amount of the deaerator is inputted thereto, and the return unit is configured to conduct the return control when the detected value of the water level or the holding water amount reaches a setting value of the water level or the holding water amount as the return condition.

8. The condensate flow rate control device for a power plant according to claim 3, wherein the return unit is configured to conduct the return control upon lapse of a set period that is set in advance from a moment of occurrence of the frequency fluctuation or the requested load change as the return condition.

9. The condensate flow rate control device for a power plant according to claim 3, wherein the return unit is configured to conduct the return control upon lapse of a set period that is set in advance from a moment when frequency or the output value of the generator reaches a target frequency setting or a requested load setting as the return condition.

10. The condensate flow rate control device for a power plant according to claim 1, wherein the water level adjustment unit is configured to calculate a setting value of the water level or a setting value of the holding water amount based on a differential value of a fluctuation width of the frequency fluctuation or a differential value of a change width of the requested load change.

11. The condensate flow rate control device for a power plant according to claim 1, wherein the water level adjustment unit is configured such that the detected value of the water level or the holding water amount of the deaerator at a moment of occurrence of the frequency fluctuation or the requested load change is inputted thereto and when the detected value of the water level or the detected value of the holding water amount is lower than a preset threshold, the water level adjustment unit is configured to disable the condensate flow rate control or conducts the condensate flow rate control while adjusting the setting value of the water level or the setting value of the holding water amount.

12. The condensate flow rate control device for a power plant according to claim 1, further comprising a switch configured to be operated by a manager and be used to switch between enabling and disabling the condensate flow rate control by the water level adjustment unit.

13. The condensate flow rate control device for a power plant according to claim 12, wherein when the fluctuation width of the frequency fluctuation or the change width of the requested load change that is consistent with the estimated value is inputted and the number of times computed based on the estimated value is zero, the condensate flow rate control by the water level adjustment unit is configured to be disabled regardless of operations of the switch by the manager.

14. The condensate flow rate control device for a power plant according to claim 1, wherein the power plant comprises a makeup water supplying unit directly connected to the deaerator and configured to supply makeup water to the deaerator in accordance with a water level or a holding water amount of the deaerator, and the makeup water supplying unit includes a makeup water tank configured to store the makeup water, a makeup water supply amount adjusting unit configured to adjust a makeup water supply amount that is supplied from the makeup water tank to the deaerator, and a heating unit configured to heat the makeup water.

15. The condensate flow rate control device for a power plant according to claim 14, wherein the heating unit is configured to heat the makeup water by using waste heat from the boiler or waste heat from another heating source.

16. A condensate flow rate control method for a power plant, the power plant having:

a boiler;

a steam turbine configured such that steam generated by the boiler is introduced thereinto;

a generator configured to be driven by the steam turbine;

a condenser configured such that exhaust hot steam from the steam turbine is supplied thereto;

a deaerator water level adjustment valve;

a deaerator configured such that condensate generated by the condenser is supplied via the deaerator water level adjustment valve thereto and bleed steam from the steam turbine is introduced thereinto; and a feed pump configured to supply feedwater deaerated by the deaerator to the boiler, the method comprising:

conducting condensate flow rate control with a water level adjustment unit by inputting a frequency fluctuation or a requested load change into the water level adjustment unit, and the water level adjusting unit adjusting pressure in a condensate flow path from the deaerator water level adjustment valve to the deaerator and thereby adjusting an amount of bleed steam from the steam turbine so that the inputted frequency fluctuation is suppressed or an output value of the generator conforms to the inputted requested load change, wherein based on a preset relationship between a fluctuation width of a frequency fluctuation or a change width of a requested load change and a change width of a water level or a holding water amount of the deaerator, a setting value of the water level or a setting value of the holding water amount is calculated from the frequency fluctuation or the requested load change, and an opening instruction is outputted to the deaerator water level adjustment valve so that the water level or the holding water amount of the deaerator assumes the setting value of the water level or the setting value of the holding water amount as the condensate flow rate control;

displaying at least one estimated value of a fluctuation width of a frequency fluctuation or a change width of a requested load change which is estimated to be inputted, and computing a remaining number of times the water level adjustment unit can conduct the condensate flow rate control based on the estimated value, a detected value of a water level or a holding water amount of the deaerator, and a lower limit of the water level or the holding water amount of the deaerator; and displaying the remaining number of times computed in association with the estimated value.

17. A power plant comprising:

a boiler:

a steam turbine configured such that steam generated by the boiler is introduced thereinto;

a generator configured to be driven by the steam turbine;

a condenser configured such that exhaust hot steam from the steam turbine is supplied thereto;

a deaerator water level adjustment valve;

a deaerator configured such that condensate generated by the condenser is supplied via the deaerator water level adjustment valve thereinto and bleed steam from the steam turbine is introduced thereinto;

a condensate flow path extending from the deaerator water level adjustment valve to the deaerator configured such that the condensate is supplied to the deaerator therethrough;

a feed pump configured to supply feedwater deaerated by the deaerator to the boiler; and a condensate flow rate control device comprising a water level adjustment unit configured to perform condensate flow rate control such that a frequency fluctuation or a requested load change is inputted into the water level adjustment unit and the water level adjustment unit adjusts pressure in the condensate flow path and thereby adjusts an amount of bleed steam from the steam turbine so that the inputted frequency fluctuation is suppressed or an output value of the generator conforms to the inputted requested load change, wherein based on a preset relationship between a fluctuation width of a frequency fluctuation or a change width of a requested load change and a change width of a water level or a holding water amount of the deaerator, the water level adjustment unit is configured to calculate a setting value of the water level or a setting value of the holding water amount from the frequency fluctuation or the requested load change and output an opening instruction to the deaerator water level adjustment valve so that the water level or the holding water amount of the deaerator assumes the setting value of the water level or the setting value of the holding water amount;

an allowable control count calculating unit configured to display at least one estimated value of a fluctuation width of a frequency fluctuation or a change width of a requested load change which is estimated to be inputted and compute a remaining number of times the water level adjustment unit can conduct the condensate flow rate control based on the estimated value, a detected value of a water level or a holding water amount of the deaerator, and a lower limit of the water level or the holding water amount of the deaerator; and a display unit configured to display the remaining number of times computed by the allowable control count calculating unit in association with the estimated value.

* * * * *